US009617799B2

(12) United States Patent
Fraignac et al.

(10) Patent No.: US 9,617,799 B2
(45) Date of Patent: Apr. 11, 2017

(54) TUBULAR COMPONENT FOR DRILL STEM PROVIDED WITH A TRANSMISSION SHEATH FIXED BY THREADINGS, AND METHOD FOR INSTALLING SAID COMPONENT

(71) Applicant: Vallourec Drilling Products France, Cosne Cours sur Loire (FR)

(72) Inventors: Alexandre Fraignac, Paris (FR); Francois Millet, Antony (FR)

(73) Assignee: VALLOUREC DRILLING PRODUCTS FRANCE, Cosne Cours sur Loire (FR)

( * ) Notice: Subject to any disclaimer, the term of this patent is extended or adjusted under 35 U.S.C. 154(b) by 408 days.

(21) Appl. No.: 14/350,284

(22) PCT Filed: Oct. 4, 2012

(86) PCT No.: PCT/EP2012/004152
§ 371 (c)(1),
(2) Date: Apr. 7, 2014

(87) PCT Pub. No.: WO2013/053449
PCT Pub. Date: Apr. 18, 2013

(65) Prior Publication Data

US 2014/0284065 A1 Sep. 25, 2014

Related U.S. Application Data

(60) Provisional application No. 61/563,055, filed on Nov. 23, 2011.

(30) Foreign Application Priority Data

Oct. 14, 2011 (FR) ..... 11 03153

(51) Int. Cl.
*E21B 17/042* (2006.01)
*E21B 17/00* (2006.01)
*E21B 17/02* (2006.01)

(52) U.S. Cl.
CPC ..... *E21B 17/042* (2013.01); *E21B 17/003* (2013.01); *E21B 17/023* (2013.01)

(58) Field of Classification Search
CPC ..... E21B 17/042; E21B 17/003; E21B 17/023
See application file for complete search history.

(56) References Cited

U.S. PATENT DOCUMENTS 2,748,358 A * 5/1956 Johnston ..... E21B 17/028 166/65.1
3,807,502 A * 4/1974 Heilhecker ..... E21B 17/003 166/385

(Continued)

FOREIGN PATENT DOCUMENTS

WO 2009 133474 11/2009

OTHER PUBLICATIONS

International Search Report Issued Sep. 18, 2013 in PCT/EP12/004152 Filed Oct. 4, 2012.

*Primary Examiner* — Brad Harcourt
(74) *Attorney, Agent, or Firm* — Oblon, McClelland, Maier & Neustadt, L.L.P.

(57) ABSTRACT

A component for a drill stem including a tubular body with at least one first end zone and a second end zone. The component includes a sheath for passage of a cable extending inside the tubular body between the first end and the second end zone and at least one liner which lines at least a portion of the inside of the tubular body in the first end zone. At least a first end portion of the sheath includes a first threading. The liner supports a second threading. The first and second threading are screwed together.

14 Claims, 10 Drawing Sheets

(56) References Cited

U.S. PATENT DOCUMENTS

| | | | |
|---|---|---|---|
| 2003/0075319 | A1 | 4/2003 | Chau |
| 2005/0098356 | A1 | 5/2005 | Chau |
| 2006/0124291 | A1 | 6/2006 | Chau |
| 2007/0056723 | A1 | 3/2007 | Hall et al. |
| 2010/0111592 | A1 | 5/2010 | Hassell et al. |
| 2011/0108267 | A1 | 5/2011 | Chaize et al. |

* cited by examiner 60
47
46
4
45
44
43
42
41
61
51
53
54
55
4b
4a
56
57
60b
60c
60a

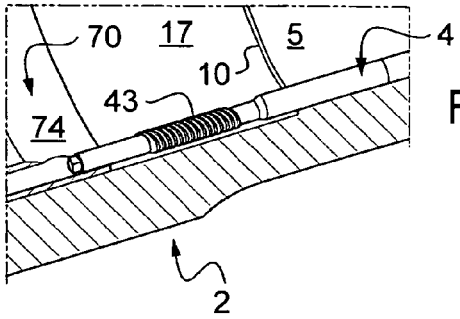
Fig.11A
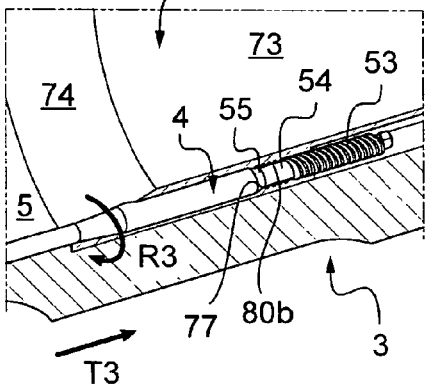
Fig.11B
Fig.11C
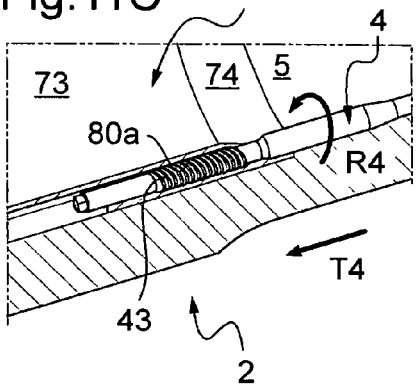
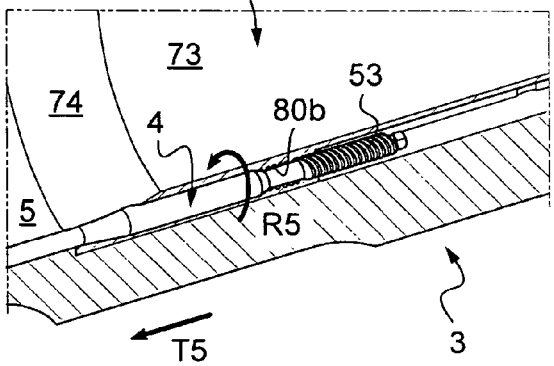
Fig.11D
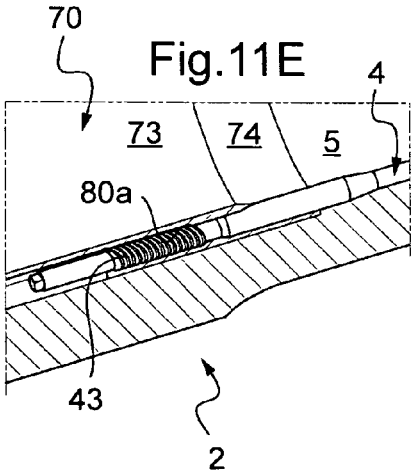
Fig.11E
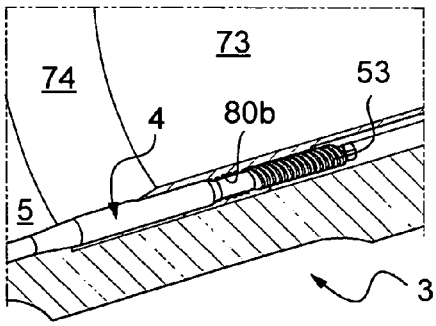
Fig.11F

TUBULAR COMPONENT FOR DRILL STEM PROVIDED WITH A TRANSMISSION SHEATH FIXED BY THREADINGS, AND METHOD FOR INSTALLING SAID COMPONENT

The invention relates to the field of exploration and operating of oil or gas wells. Rotary drill pipe strings are used therein which are constituted by tubular components such as drill pipes which may be standard or heavy weight, and other tubular elements.

More particularly, the invention concerns a tubular component which can be cabled. Such components can be used to transmit information from one end to the other of the drill pipes.

For a better understanding of the events occurring at the hole bottom, bottom hole assemblies can be provided with measuring instruments. The measured data are communicated to the surface for processing. Data transfer is generally ensured by means of a communications cable housed in a communications line. The line is disposed in a drill pipe, in the bore in the regular section and in a hole provided in the thickness of the walls at the ends. However, the communications line might vibrate or become displaced, giving rise to a risk of premature rupture. Holding the cabling elements in a tubular component is complex and expensive.

A need has arisen for the cabling elements to be fixed in the tubular components in a reliable manner. The Applicant has identified that a device that can be readily installed and removed, especially during maintenance, while preserving the tubular component, is desirable. The capability of being removed from the device is useful, for example, when an interior coating is produced on the tubular component during maintenance, which necessitates heating to a temperature of the order of 400° C. Such a device is advantageously capable of being adapted to a large majority of existing tubular components, in particular components with thin walls. Such devices are desirably designed with a restricted number of elements to improve simplicity and reliability. Preferably, such devices should not be expensive. Accuracy in adjusting an axial tensile pre-stressing load on a sheath in the tubular component is important. Existing devices such as those known from the document US/2010/0111592 do not adequately fulfil these requirements.

The invention will improve the situation.

The drill stem component comprises a tubular body. The tubular body comprises at least one first end zone and a second end zone. The first end zone is provided with a shoulder. The drill stem component comprises a sheath for the passage of a cable extending inside the tubular body between the first end zone and the second end zone. The drill stem component also comprises at least one liner. The liner lines at least part of the inside of the tubular body in the first end zone. The liner abuts against the shoulder. At least one first end portion of the sheath is provided with a first threading. The liner supports a second threading. The first and the second threadings are screwed together. An end portion of the sheath is thus fixed to the first end zone of the tubular body. The relative axial position of the first end portion of the sheath with respect to the first end zone of the tubular body can thus be adapted by screwing and/or unscrewing. The integrity of the end zone is thus preserved. Standards imposed upon non-cabled components can be complied with. The sheath can ensure axial retention of the liner in the tubular body. This disposition is advantageous since it means that the liner can be retained without the need to add an adhesive between the liner and the tubular body.

The liner comprises an external surface. The external surface overlays at least a portion of an internal surface of the tubular body in the first end zone. The internal surface of the tubular body corresponds to the surface of the body against which the drilling mud passes. At right angles to the liner, the drilling mud passes along the liner which locally protects the internal surface of the tubular body.

The liner comprises end surfaces axially disposed in the first end zone.

The first end zone comprises an internal surface. The liner comprises an exterior surface in contact with the internal surface of the first end zone over an angular space sector of the tubular body which is strictly less than 360°. The liner may cover an axially limited zone of the internal surface of the first end zone. The liner may cover an angular sector of said internal surface of the tubular body which is strictly less than 360° and in this case covers an angular sector of less than 120°, preferably less than 60°, for example in the range 15° to 30° or in the range 5° to 15°.

The liner comprises a wall with a thickness strictly greater than the external diameter of the first end portion of the sheath. The second threading is provided in said wall.

The liner comprises end surfaces. The tubular body may also comprise an intermediate portion between the first end zone and the second end zone. Each of the axial ends of the liner may be disposed at an axial distance from a junction between the intermediate portion and the first end zone.

The first end portion of the sheath may be free to rotate about an axis of the sheath with respect to a second end portion opposite to the first end portion. Thus, the independence of screwing of each of the end portions of the sheath into each of the end zones of the tubular body is preserved. The sheath is subjected to few or no torsional stresses.

The sheath may also comprise a rotary seal between the first end portion and the second end portion.

The second end zone may be provided with a shoulder. The drill stem component may also comprise a supplemental liner. The supplemental liner lines at least a portion of the interior of the tubular body in the second end zone. The supplemental liner abuts against the shoulder of the second end zone. A second end portion of the sheath, opposite to the first end portion, is provided with a third threading. The supplemental liner supports a fourth threading. The third and fourth threadings are screwed together. The relative axial position of each of the end portions of the sheath with respect to each of the end zones of the tubular body may thus be adapted by screwing up or unscrewing. The integrity of each of the end zones is thus preserved.

The first and second threading and/or the third and fourth threadings may be produced with self-locking thread profiles.

One or other of the first threading and the third threading may be a left handed threading while the other is a right handed threading. This allows simultaneous screwing up of each of the end portions of the sheath, with the sheath rotating about its own axis of revolution in a single direction and each of the end portions of the sheath undergoing translation in mutually opposite directions. The sheath may be placed under a tensile pre-stressing axial load by a single screwing up operation. In this manner, rotation of the sheath about its own axis of revolution and in a single direction allows translation of each of the end portions of the sheath with respect to each of the end zones of the tubular body in opposite directions.

The first threading and the third threading may have different pitch values. This means that each of the end portions of the sheath can be mutually moved apart or brought together by a different amount for a given angle of rotation of the sheath on screwing up or unscrewing. This means that the axial tensile load on the sheath and its position can be selected simultaneously as a function of the screwing or unscrewing operation. In this manner, rotation of the sheath about its own axis of revolution allows translation of each of the end portions of the sheath with respect to each of the end zones of the tubular body in identical or opposite directions but with different translational values for a given angle of rotation.

The invention also concerns a method for installing a drill stem component in which the component comprises a tubular body having at least a first end zone provided with a shoulder and a second end zone and a sheath for the passage of a cable. Said method comprises:

inserting a first end portion of the sheath into the first end zone, the first end portion including a first threading;

screwing the first threading and a second threading together, the second threading being supported by a liner which lines at least a portion of the interior of the tubular body in the first end zone. The liner abuts against the shoulder.

Screwing up may be brought about by applying a torque to the first end portion of the sheath, optionally initially placing the sheath under tension.

The method may also comprise:

inserting a second end portion of the sheath into the second end zone provided with a shoulder, the second end portion of the sheath opposite to the first end portion being provided with a third threading;

screwing the third threading and a fourth threading together, the fourth threading being supported by a supplemental liner which lines at least a portion of the interior of the tubular body in the second end zone, the supplemental liner abutting against the shoulder.

Screwing up may be carried out by applying a torque in the same direction to the first end portion and to the second end portion of the sheath.

The method may also comprise a supplemental step:

unscrewing the third and fourth threadings or the first and second threadings from each other. This means that an end portion of the sheath can be screwed up substantially simultaneously with unscrewing another end portion of the same sheath which has already been screwed up or over torqued. This means that the deformation of the sheath necessary for installation can be reduced. The position of the sheath in the tubular component is reliable over time. The number of installation operations is then limited and pre-set at the design stage. Certain installation steps, for example the first time the sheath is screwed into the liner which has not yet been fed into the tubular body, may be carried out prior to final installation.

Screwing up the first and second threadings as well as unscrewing the third and fourth threadings, or screwing up the first and second threadings and unscrewing the third and fourth threadings, may be carried out by applying a torque in the same direction. Said screwing up and said unscrewing operations may be carried out substantially simultaneously or consecutively.

Screwing up and/or unscrewing the first and second threadings on the one hand and the third and fourth threadings on the other hand may be carried out independently.

The invention also concerns a kit of components for a drill stem. The kit comprises a tubular body with at least one first end zone provided with a shoulder and a second end zone. The kit comprises a sheath for the passage of a cable disposed inside the tubular body between the first end zone and the second end zone. The kit comprises at least one liner intended to line at least a portion of the inside of the tubular body in the first end zone and to abut against the shoulder. At least a first end portion of the sheath is provided with a first threading. The liner supports a second threading. The first and second threadings screw together.

Further characteristics and advantages of the invention will become apparent from the following detailed description and the accompanying drawings in which:

FIGS. 11A to 11F are diagrammatic views in longitudinal section, in perspective and in detail, of the installation steps, with the sheath being shown;

Figure 1:
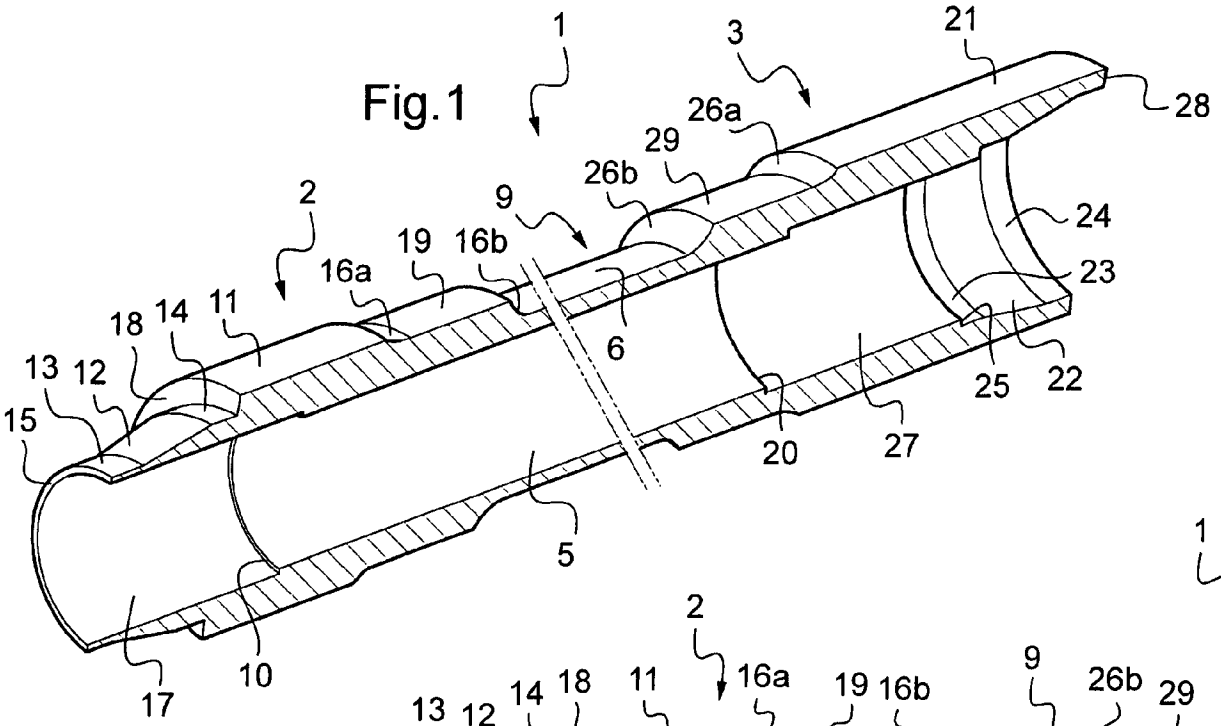
FIG. 1 is a diagrammatic view in longitudinal section and in perspective of a tubular body.

The accompanying drawings are essentially of a concrete nature and may not only serve to provide a better understanding of the present invention, but they may also, if necessary, contribute to its definition.

The drill stem may comprise a plurality of pipes, in particular standard pipes obtained by assembling, by welding, a male end zone, a great length tube and a female end zone on the opposite side from the male end zone to form sealed tubular threaded connections by said assembly, and possibly heavy weight pipes. A pipe may be one of several types in accordance with specification API7 from the American Petroleum Institute or in accordance with the manufacturer's own designs. The tubular components of the drill pipe may be of the types described in the documents U.S.

Pat. Nos. 6,670,880, 6,717,501, US 2005/0115717, US 2005/0092499, US 2006/0225926, FR 2 936 554 or FR 2 940 816.

The term "substantially" as used below accommodates the usual tolerances in the technique field under consideration. Unless otherwise stated, the terms "axis" and "axial" refer to the longitudinal axis of the tubular component. Finally, the terms "small" and "large" diameters are relative terms defining one portion with respect to another, axially neighbouring, portion.

When excavating a well, a drill stem is suspended in the well. The drill stem is composed of tubular components connected one after the other and includes a bottom hole assembly. A component may include measuring sensors, for example for measuring pressure, temperature, stress, inclination, resistivity, etc. The drill stem may include standard length tubes, for example 10 meters, and instrumentation components.

A plurality of transmission devices (or couplers) such as those described in document U.S. Pat. No. 6,641,434, reference to which is invited by way of example, may be interconnected inside the drill stem to form a communications link. The two end zones of a tubular body of a drilling component are each equipped with a transmission device. The two transmission devices of the component are connected via a cable, substantially over the length of the component. The cable is disposed in a protective sheath or tube, and the ensemble is termed the communications line. The communications line is in general inserted in a hole provided in the thickness of the end zones of the tubular body. In an intermediate or central portion of the tubular body, the communications line is disposed in the bore of said tubular body because the wall of the intermediate portion is much thinner compared with the thickness of the wall of the end zones.

The device can be used to fix a sheath in a tubular component of the drill stem. The device can also be used to adjust the axial tensile load on the sheath inside the tubular component. The device can be produced for small diameter tubular bodies which also have thin walls. The device limits the number of parts needed to fix the sheath in the tubular component.

The installation method comprises a limited number of operations. The installation method can readily be reversed. Removal and maintenance of such a device are facilitated by the method. The installation method can be used to finely adjust the loads applied to the sheath during installation. This loading prior to using the component means that movements of the sheath that could lead to fatigue and deterioration of the component can be limited. Axial tensile loading of the sheath during installation means that a portion of the axial compression of the sheath during operation can be absorbed. As an example, under drilling conditions, the tubular body supporting the sheath may be subjected to an axial compression, which also tends to compress the sheath axially.

The device comprises a drill stem component which can be used to transmit data in a reliable manner over time and over the length of the drill stem while allowing the component to be used again. The sheath which is fixed with respect to an end zone of the tubular body of the drill stem component is improved, movements are limited, and wear is reduced, especially when the drill stem is under intense mechanical load. Loads notably include traction, compression, torsion and/or buckling, under a variety of pressures, both internal and external, and a variety of temperatures, vibrations and shocks.

The device can be adapted to existing tubular bodies by means of an intervention carried out during maintenance. Producing threadings included in a liner disposed in in the end zone or zones means that the mechanical integrity of the intermediate portion of the tubular body can be preserved. Since the end zones generally comprise walls with a thickness greater than that of the intermediate portion, said end zones are zones which are less critical from a mechanical viewpoint than the intermediate portion in terms of tensile, compressive, bending or torsional loads. Adapting the end zones, preserving the intermediate portion, means that expensive mechanical tests which have already been carried out for existing tubular bodies can be dispensed with.

A component 100 comprises a tubular body 1 or primary tube represented in FIG. 1. The tubular body 1 of the drill stem comprises a first end zone 2, a second end zone 3 and an intermediate or central portion 9. The material and structure of the tubular body 1 are impervious.

In the embodiments shown in the figures, the tubular bodies 1 are of types comprising a male end and a female end. This is suitable for connecting a drill stem comprising a succession of components of the "male-female" or "integral" type. In another embodiment, the tubular bodies may be of two distinct types assembled alternately and repetitively along a drill stem, a component comprising two male ends then a coupling comprising two female ends. This is the case when connecting a drill stem comprising a succession of components of the "male-male" and "female-female" type. In the figures, the first end zone 2 is male and the second end zone 3 is female. The first end zone 2 may be female. The second end zone 3 may be male.

The intermediate portion 9 is elongate in shape over a length from 5 to 15 meters for long components, for example drill pipes, and 1 to 5 meters for short components, for example subs used at the well head. The internal and external diameter may vary or be constant in the axial direction. The thicknesses may vary. The bore may be constant. The internal diameter may, for example, be from 25 to 400mm and the external diameter may be from 50 to 500 mm.

The intermediate portion 9 is formed from steel. The intermediate portion 9 may comprise an alloy of aluminium, titanium or a composite comprising a polymer filled with reinforcing fibres. The intermediate portion 9 may be a tube obtained by a continuous casting or forging technique. The tubular body may be the result of friction welding each of the end zones 2, 3 either side of the tube forming the intermediate portion 9. The ends of the intermediate portion 9 may be forged, upset or thickened in order to enlarge the radial welding surface. The forging, spinning or thickening may be carried out on the external side of the wall forming the intermediate portion 9, leaving a constant diameter bore or internal surface.

The end zones 2, 3 are formed from steel. The first and second end zones 2, 3 are generally tubular in shape. The first and second end zones 2, 3 are generally attached to each end of the intermediate portion 9. Said end zones 2, 3 generally have an external diameter which is greater than that of the intermediate portion 9, for example by 100% to 150%. Said end zones 2, 3 generally have an internal diameter which is less than that of the intermediate portion 9, for example by 80% to less than 100%.

Figure 2:
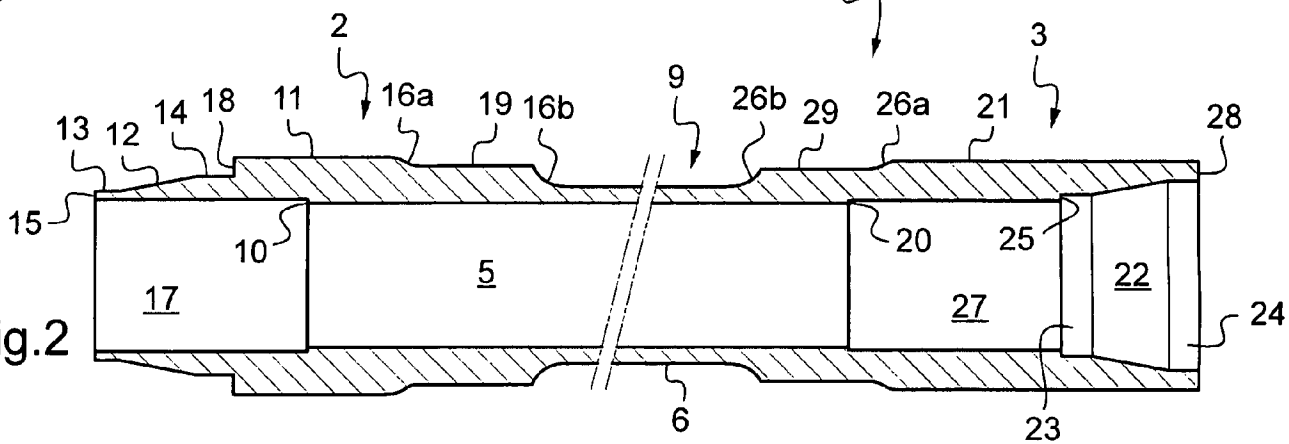
FIG. 2 is a diagrammatic view in longitudinal section of a tubular body.

As can be seen in FIGS. 1 and 2, the external surface of the first end zone 2 comprises a substantially cylindrical large diameter external annular surface 11. The external surface of the first end zone 2 comprises a substantially cylindrical small diameter external annular surface 19. The small diameter annular external surface 19 is located axially on the side of the intermediate portion 9 compared with the large diameter external annular surface 11. The large and small diameter external annular surfaces 11 and 19 are linked via an annular shoulder 16*a*. The small diameter external annular surface 19 is linked to a substantially cylindrical external surface 6 of the intermediate portion 9 via an annular shoulder 16*b*. The link between the external surface 6 and the annular shoulder 16*b* defines a junction between the first end zone 2 and the intermediate portion 9. The external surface 6 of the intermediate portion 9 is linked to a substantially cylindrical small diameter external annular surface 29 of the second end zone 3 via an annular shoulder 26*b*. The link between the external surface 6 and the annular shoulder 26*b* defines a junction between the second end zone 3 and the intermediate portion 9. The small diameter external annular surface 29 is linked to a substantially cylindrical large diameter external annular surface 21 of the second end zone 3 via an annular shoulder 26*a*.

The first end zone 2 comprises an external (or male) threading 12, not shown. The surface comprising the external threading 12 is substantially tapered and located axially between a first substantially cylindrical external annular surface 13 on the side opposite to the intermediate portion 9 and a second substantially cylindrical external annular surface 14 on the side of the intermediate portion 9. The second external annular surface 14 is linked to the large diameter external annular surface 11 via an annular surface 18. The annular surface 18 is substantially perpendicular to the axis of revolution of the tubular body 1. The first external annular surface 13 is linked to an internal surface of the tubular body 1 via an end surface 15. The end surface 15 is substantially perpendicular to the axis of revolution of the tubular body 1. The end surface 15 delimits a substantially cylindrical bore of the first end zone 17.

The second end zone 3 comprises an internal (or female) threading 22, not shown. The surface comprising the internal threading 22 is substantially tapered and located axially between a substantially cylindrical first internal annular surface 23 located on the side of the intermediate portion 9 and a substantially cylindrical second internal annular surface 24 located on the side opposite to the intermediate portion 9. The second internal annular surface 24 is connected to the large diameter external annular surface 21 via an end surface 28. The end surface 28 is substantially perpendicular to the axis of revolution of the tubular body 1. The first internal annular surface 23 is linked to a substantially cylindrical bore of the second end zone 27 in the bore of the tubular body 1 via a shoulder 25. The shoulder 25 is substantially perpendicular to the axis of revolution of the tubular body 1.

The tubular body 1 comprises a substantially cylindrical intermediate bore 5 located axially between the bore of the first end zone 17 and the bore of the second end zone 27. The intermediate bore 5, the bore of the first end zone 17 and the bore of the second end zone 27 each form an internal surface of the tubular body 1. The bore of the first end zone 17 is linked to the intermediate bore 5 via a shoulder 10. The surface of the shoulder 10 is substantially perpendicular to the axis of revolution of the tubular body 1. The bore of the second end zone 27 is linked to an intermediate bore 5 via a shoulder 20. The surface of the shoulder 20 is substantially perpendicular to the axis of revolution of the tubular body 1. The bores of the first end zone 17 and the second end zone 27 have diameters which, in the example described here, are greater than that of the intermediate bore 5. The shoulders 10 and 20 are thus orientated towards the sides opposite the intermediate portion 9.

In general, the external surfaces and the internal surfaces or bores of the tubular body 1 are substantially concentric with the centre being the axis of the tubular body 1. For clarity, the threads of the external 12 and internal 22 threadings are not shown in the figures.

In other words, in an axial direction orientated from the free end of the first end zone 2 to the free end of the second end zone 3, i.e. from left to right in FIGS. 1 and 2, on the outside of the tubular body 1, the following are present in order:

- belonging to the first end zone 2: the end surface 15, the first external annular surface 13, the surface supporting the external threading 12, the second external annular surface 14, the annular surface 18, the large diameter external annular surface 11, the annular shoulder 16*a*, the small diameter external annular surface 19, the annular shoulder 16*b;*
- belonging to the intermediate portion 9: the external surface 6;
- belonging to the second end zone 3: the annular shoulder 26*b*, the small diameter external annular surface 29, the annular shoulder 26*a*, the large diameter external annular surface 21 and the end surface 28.

In an axial direction orientated from the free end of the first end zone 2 to the free end of the second end zone 3, i.e. from left to right in FIGS. 1 and 2, on the inside of the tubular body 1, the following are present in order:

- belonging to the first end zone 2: the bore of the first end zone 17, the shoulder 10, a portion of the intermediate bore 5;
- belonging to the intermediate portion 9: a portion of the intermediate bore 5;
- belonging to the second end zone 3: a portion of the intermediate bore 5, the shoulder 20, the bore of the second end zone 27, the shoulder 25, the first internal annular surface 23, the surface supporting the internal threading 22 and the second internal annular surface 24.

Advantageously, the shoulder 10 is formed at a radial portion facing the large diameter external annular surface 11. Conversely, the shoulder 20 is formed at a radial portion facing the small diameter external annular surface 29.

The thicknesses of the walls constituting the end zones 2, 3 are generally substantially greater than that of the wall constituting the intermediate portion 9. This surplus thickness means that supplemental machining can be carried out.

The male/female end zones 2, 3 and more particularly their internal/external threading 12, 22 are adapted to interact by making up with a female/male end zone 3, 2 of a compatible tubular component intended to be fixed to the first component 100 to form a drill stem.

During such connection, the external threading 12 of a first component is made up with the internal threading 22 of a second component. The end surface 15 of the first component is brought to face or abut against the shoulder 25 of the second component. The first external annular surface 13 of the first component is brought to face the first internal annular surface 23 of the second component. The second external annular surface 14 of the first component is brought to face the second internal annular surface 24 of the second component. The annular surface 18 of the first component is brought to face or abut against the end surface 28 of the second component. Each of the pairs constituted by the end surface 15 and the shoulder 25 on the one hand and the annular surface 18 and the end surface 28 on the other hand may be a pair of surfaces that abut at the end of makeup, for example to stop makeup and/or to provide a seal.

Preferably, when associating two tubular components such as 100 together, the dimensions are adjusted so that the annular surface 18 comes into contact with the end surface 28 before the end surface 15 comes into contact with the shoulder 25, in order to provide a seal over the external circumference of the drill stem components when connected together.

Figures 3, 16:
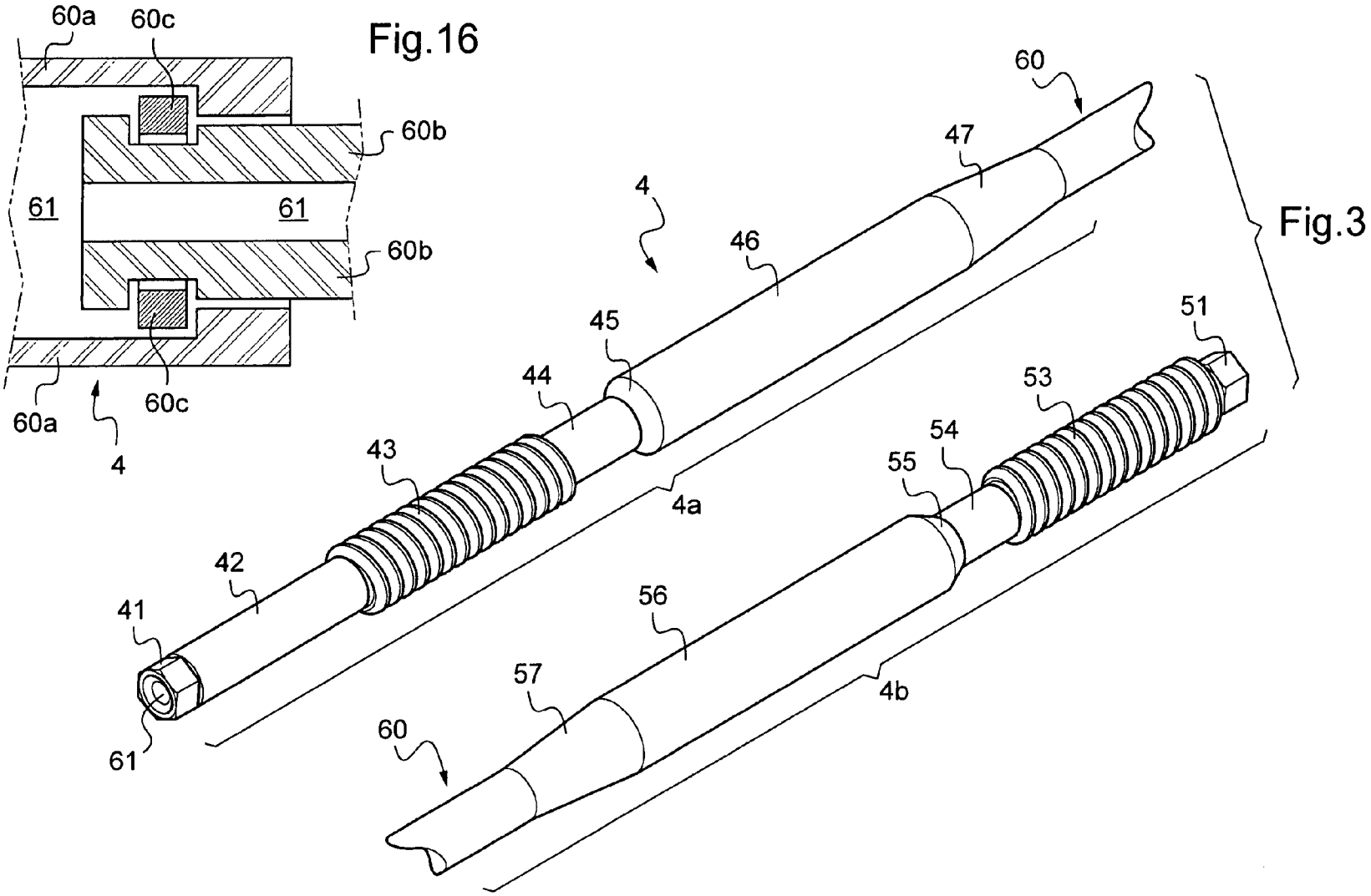
FIG. 3 is a diagrammatic perspective view of the ends of the sheath.
FIG. 16 is a diagrammatic view of a portion of the sheath.
Figure 4:
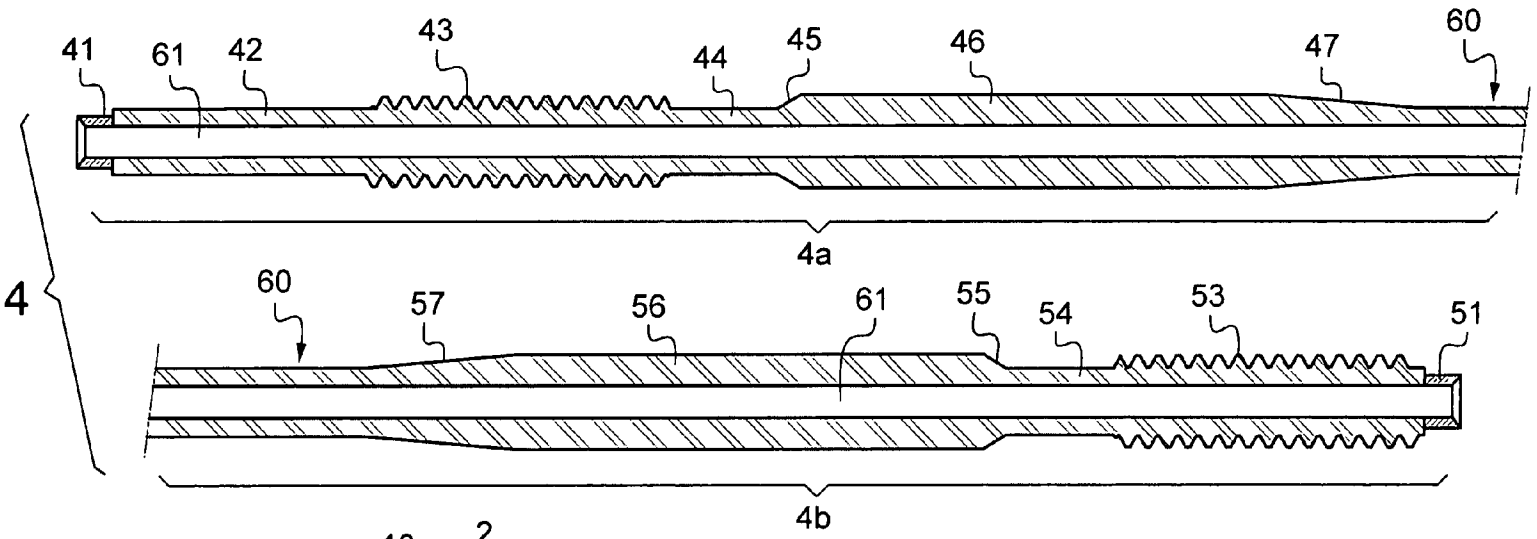
FIG. 4 is a diagrammatic sectional view of the ends of the sheath.

A sheath 4, not yet installed in the tubular body 1, is shown in FIGS. 3 and 4. The sheath 4 has a generally continuous tubular shape. The internal diameter is selected so as to be greater than the diameter of a cable 90 (not shown) intended to be housed in the sheath 4. The thickness of the wall forming the sheath 4 is adapted to resist mechanical loads to which the sheath is subjected when functioning, during installation, during removal, and during maintenance. The length of the sheath 4 is selected so that in the installed condition in the tubular body 1, the sheath 4 extends from the first end zone 2 and the second end zone 3 of the tubular body 1. The sheath 4 is substantially longitudinal. The sheath 4 has a substantially impervious structure. The sheath 4 comprises an impervious material which allows it to undergo substantial bending. The sheath 4 may be produced from metal, for example a nickel-iron-chromium alloy, for example Incoloy 825 or 718, or stainless steel, for example AISI 316L. The sheath 4 may include rubber, poly(p-phenyleneterephthalamide) (sold under the trade name Kevlar®) or a combination of the two. The external surface of the sheath 4 may undergo surface treatments that are suitable for improving its resistance to contact by physically and chemical aggressive fluids intended to transit such tubes.

The sheath 4 comprises a tubular intermediate portion 60 with a substantially constant section. In FIGS. 3 and 4, for practical reasons, the intermediate portion 60 has been truncated. After installation, the intermediate portion 60 is intended to be flush against the intermediate bore 5 of the tubular body 1. The sheath 4 comprises a first end portion 4*a* and a second end portion 4*b* disposed at each end of the intermediate portion 60. The sheath 4 comprises a substantially constant bore 61 which may also be smooth, in order to facilitate sliding a cable in said bore 61.

The first end portion 4*a* comprises, in the following order in an axial direction from its free end to the intermediate portion 60 (from left to right in the figures): an actuating portion 41 (in this case hexagonal), a small diameter external cylindrical surface 42, a male (or external) threading 43 the external diameter of which is greater than that of the small diameter external cylindrical surface 42, a small diameter cylindrical surface 44 with a diameter substantially equal to that of the small diameter external cylinder surface 42, a link 45, a large diameter cylindrical surface 46 and a tapered surface 47 linked to the intermediate portion 60. The large diameter cylindrical portion 46 has an external diameter at least equal to that of the male threading 43 and greater than that of the intermediate portion 60. In a variation, the small diameter external cylindrical surface 42 and/or the small diameter cylinder surface 44 may be absent. In a variation, the link 45, the large diameter cylindrical surface 46 and the tapered surface 47 may be absent. In other words, the first end portion 4*a* may comprise an actuating portion 41 and a male threading 43 linked directly to the intermediate portion 60. The second end portion 4*b* comprises, in the following order in an axial direction moving from the intermediate portion 60 to its free end (from left to right in the figures): a tapered surface 57 linked to the intermediate portion 60, a large diameter cylindrical surface 56, a link 55, a small diameter cylindrical surface 54, a male threading 53 with an external diameter which is larger than that of the small diameter cylindrical surface 54, an actuating surface 51. The large diameter cylindrical surface 56 has an external diameter at least equal to that of the male threading 53 and greater than that of the intermediate portion 60. In a variation, the link 55, the large diameter cylindrical surface 56 and the tapered surface 57 may be absent. In a variation, the small diameter 54 may be absent. In other words, the second end portion 4*b* may comprise an actuating portion 51 and a male threading 53 linked directly to the intermediate portion 60.

The sheath 4 has a length strictly less than the total length of the tubular body 1. The total length of the sheath 4 is strictly greater than the length of the intermediate portion 9 of the tubular body 1. The sheath 4 has, for example, a length in the range 4.5 to 14.5 meters, for a long tubular component 100 with a length in the range from approximately 5 to 15 meters. The sheath 4 has an external diameter and an internal diameter. The internal diameter is adapted to allow a cable 90 for the transmission of energy and/or data to be fed through. The external diameter is adapted to provide the sheath 4 with sufficient thickness to protect the cable 90 in operation while allowing the sheath 4 some flexibility over its length. The sheath 4 may have a thickness in the range 0.5 to 5 mm. The sheath 4 stiffens the transmission line in order to limit vibrations, displacements and cavitation phenomena in contact with the mud, in particular in the intermediate portion 9. In the example described here, the internal diameter is substantially constant over the length. The internal diameter may vary over the length of the sheath 4.

Figure 5:
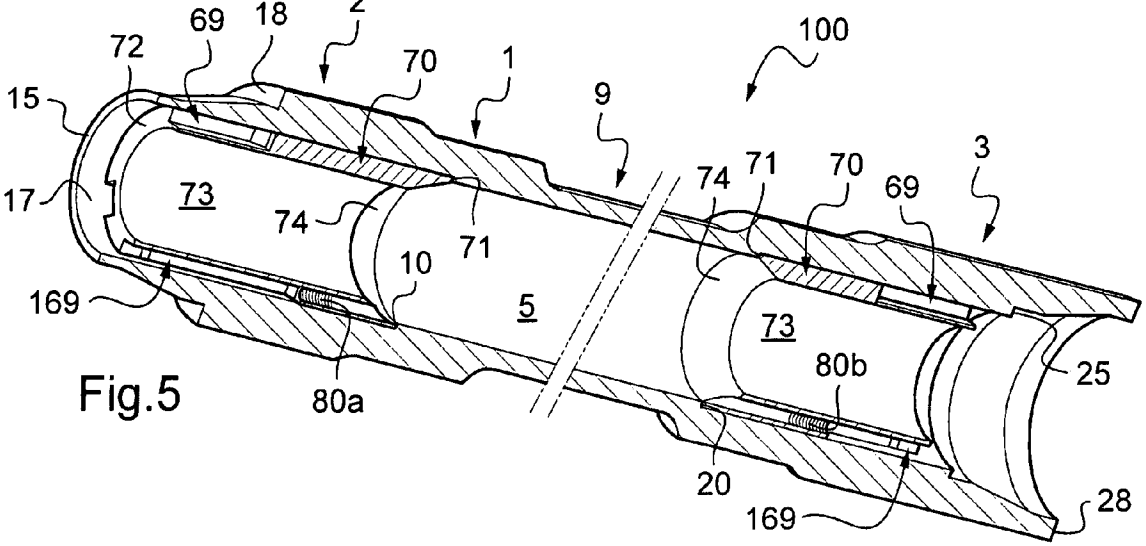
FIG. 5 is a diagrammatic view in longitudinal section and in perspective of the tubular component, with the sheath not being shown.
Figure 6:
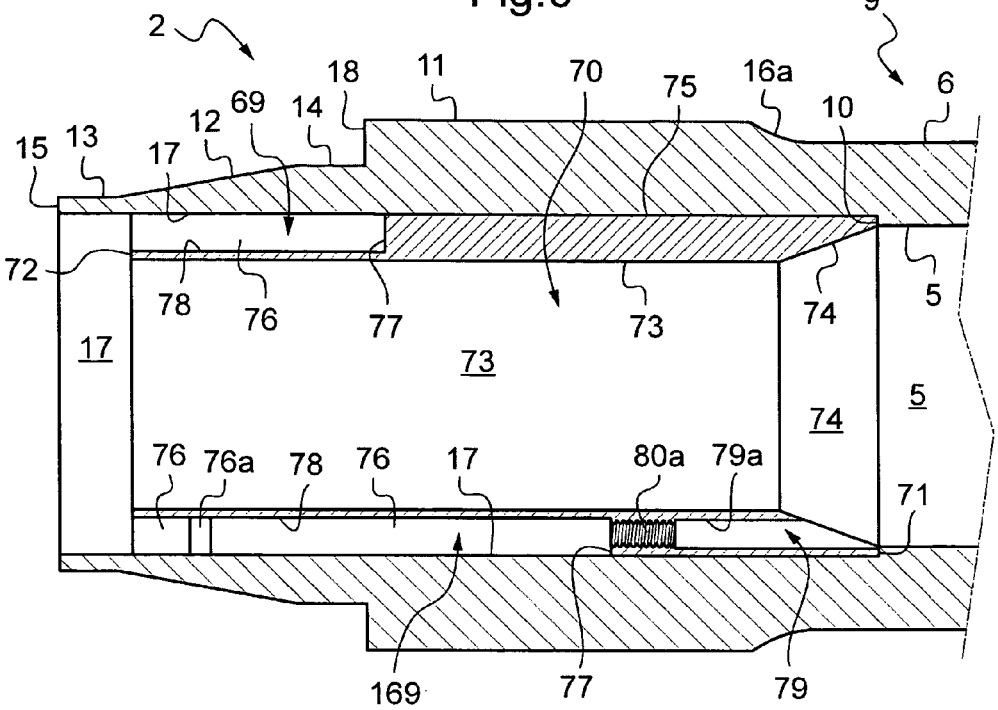
FIG. 6 is a detailed view of FIG. 5.
Figure 7:
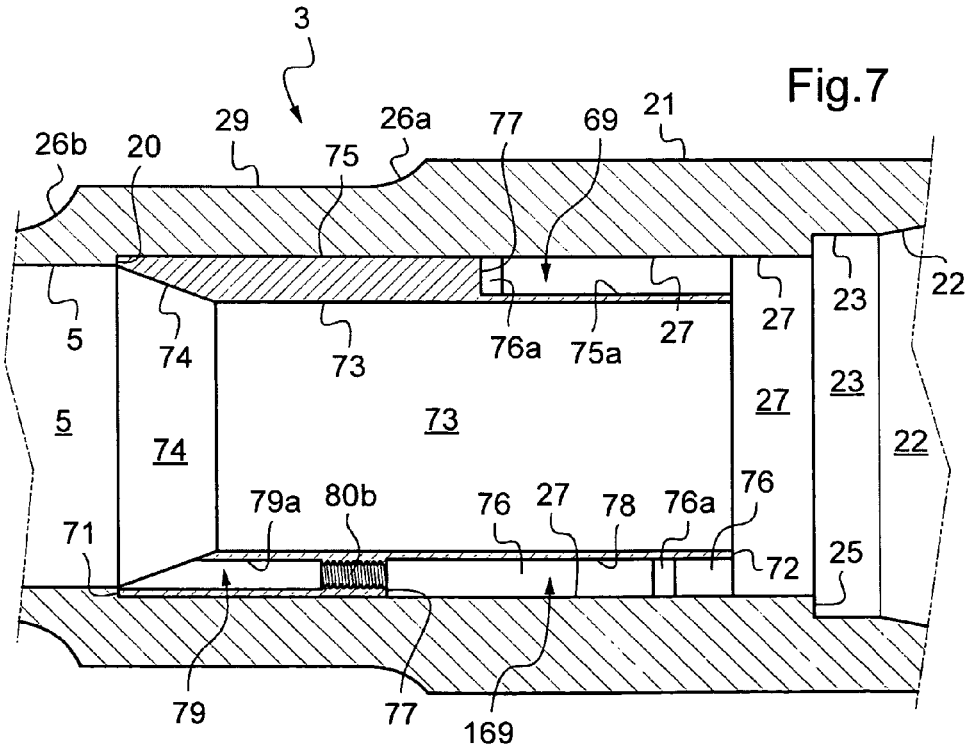
FIG. 7 is a detailed view of FIG. 5.

The tubular component 100 comprises at least one liner 70. The tubular component 100 is provided in each of the end zones 2 and 3 of the tubular body 1 with a liner 70, see FIGS. 5 to 7. Each of the linings 70 is respectively fixed in the bore of the first end zone 17 and in the bore of the second end zone 27. In the installed condition, the liner 70 is substantially coaxial with the tubular body 1.

In the following paragraphs, we shall simultaneously describe each of the linings 70 in each of the end zones 2 and 3, their shape and their disposition being substantially symmetrical with respect to a sectional plane perpendicular to the axis of the tubular component 100. The liner 70 comprises steel or any other material having suitable mechanical properties. The liner 70 comprises a substantially impervious material. The structure of the liner 70 is substantially impervious.

In the embodiments shown in FIGS. 5 to 16, the liner 70 is a part with a generally tubular, continuous shape.

The length of the liner 70 is selected so as to be substantially less than the length of the bore of the end zone 17 or respectively 27 in which it is intended to be disposed. The liner 70 comprises a bore 73, an internal tapered surface 74 and an external surface 75. The liner 70 comprises two end surfaces: a head terminal surface 71 and a tail terminal surface 72.

The head 71 and tail 72 terminal surfaces are substantially annular. The distance between the head terminal surface 71 and the tail terminal surface 72 determines the length of the liner 70. The bore 73 is substantially cylindrical and smooth. The bore 73 extends axially from the tail terminal surface 72 to the tapered internal surface 74. The tapered surface 74 extends axially from the bore 73 to the head terminal surface 71. The tapered internal surface 74 forms an enlargement of the bore of the liner 70 in an axial direction orientated from the bore 73 towards the head terminal surface 71.

In the embodiments shown in FIGS. 5 to 16, the external surface 75 is substantially cylindrical and extends axially from the head terminal surface 71 to the tail terminal surface 72. In this embodiment, for a given axial zone, the whole of the external surface 75 is applied to the whole of the periphery of the internal wall of the tube 1 of this zone.

The dimensions of the liner 70 are adapted so that, once installed in the tubular body 1, the head terminal surface 71 abuts against the shoulder 10, respectively 20, of the first end zone 2, respectively the second end zone 3. The tail terminal surface 72 is set back axially with respect to the end surface 15, respectively the shoulder 25. An axial portion of the bore of the first end zone 17, respectively the second end zone 27, is thus left free. The axial portion which is left free may serve as a housing for a transmission device 81 as mentioned above (cf. FIG. 17). The combination of the tail terminal surface 72 of the liner 70 and the axial portion which is left free of the bore of the first end zone 17, respectively the second end zone 27, forms a housing for the transmission device 81. The length of the liner 70 is less than the length of the first end zone 2, respectively the second end zone 3. The length of the liner 70 may, for example, be in the range 100 to 500 mm.

The head terminal surface 71, abutting against the shoulder 10, respectively 20, is axially disposed in the first end zone 2, respectively in the second end zone 3. The head terminal surface 71 is axially disposed at a distance from a junction between the intermediate portion 9 and the first end zone 2, respectively the second end zone 3. The tail terminal surface 72 is axially disposed at a distance from a junction between the intermediate portion 9 and the first end zone 2, respectively the second end zone 3. The intermediate portion 9 is devoid of a liner 70.

In the installed condition, the liner 70 lines at least a portion of the inside of the tubular body 1. The liner 70 covers a portion of the bore of the end zone 17; 27. The external diameter of the liner 70 is selected so as to correspond with the internal diameter of the first end zone 17, respectively the second end zone 27, for example so that it can be push fitted.

The bore 73 and the tapered internal surface 74 of the liner 70 thus form a portion of the bore of the tubular component 100. In operation, the flow of mud and other materials transits the bore 73 and the tapered internal surface 74 of the liner 70. The intermediate bore 5 of the intermediate portion 9, the tapered internal surface 74 and the bore 73 are substantially continuous. This continuity of the internal surfaces of the tubular component 100 means that the mud flow is good.

A tubular body 1 in which a liner 70 is disposed in each of its end zones 2, 3 has a portion of each of its bores of the first end zone 17 and the second end zone 27 covered and protected from the passage of mud in operation. The tubular component 100 thus has an internal surface which is subjected to the passage of mud comprising the bore 73, the tapered internal surface 74, the intermediate bore 5, the tapered internal surface 74 and the bore 73 of the other liner of the second end zone.

As an example, in the examples of FIGS. 5 to 17, the internal diameter of the bore 73 may be in the range 80% to 120% of the value of the internal diameter of the intermediate bore 5.

In the example described here, the liner 70 has a substantially constant external diameter over the length of the liner 70. The liner 70 has a substantially constant internal diameter over the length comprising the bore 73. The difference between the internal diameter and the external diameter of the liner 70 determines the thickness of the wall forming the liner 70. The thickness of the wall forming the liner 70 in this case is strictly greater than the external diameter of the end portion 4*a*, 4*b* of the sheath 4 intended to be fixed in the liner 70. The thickness of the liner 70 may be in the range 4 to 20 mm.

Figures 18, 19:
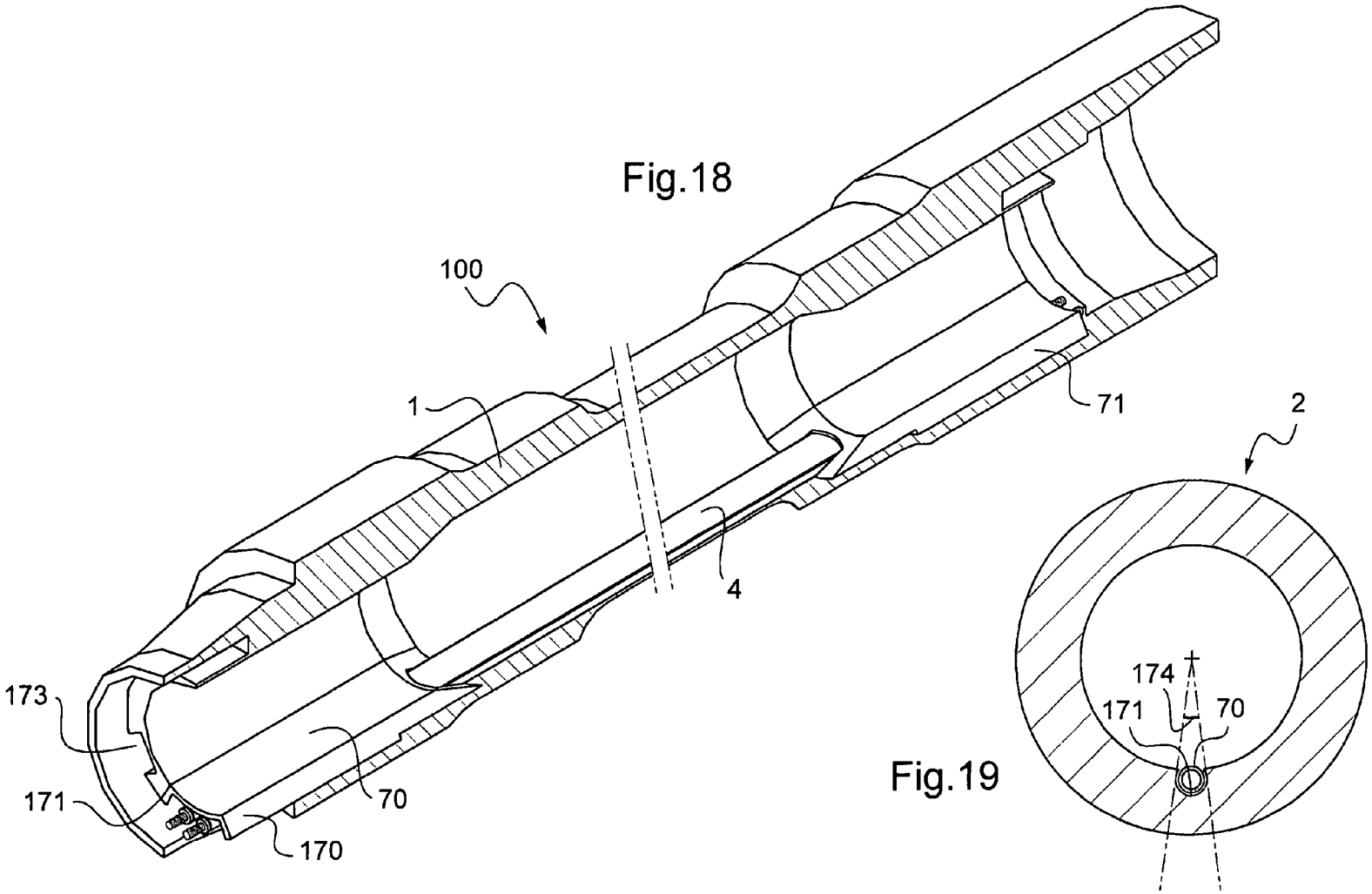
FIG. 18 is a partial diagrammatic view in longitudinal section and in perspective of a variation of a cabled component of the invention.
FIG. 19 is a partial diagrammatic view in cross section of another variation of a cabled component of the invention.

In a variation, in the embodiment of FIG. 18, the liner 70 in this case is shown covering only an angular sector of a cylinder, for example a sector which makes contact with a sector of the order of 60° of the internal circumference of the end zone. This end zone thus comprises a housing 171 to receive the liner 70 by sliding. The liner 70 is radially retained there by two laterally opposed profiles 170 extending between the head terminal surface 71 and the tail terminal surface 72, with a dovetail shape intended to cooperate with complementary surfaces of the housing 171. In the example shown, the sheath 4 has sufficient space to house two cables extending from one end of the component 100 to the other.

In a variation of the embodiment of FIG. 18, FIG. 19 shows a cylindrically shaped liner 70 with an external diameter substantially smaller than the external diameter of the liner 70 as seen in FIGS. 5 to 17. This variation of the liner in FIG. 19 is retained in a housing 171 with a section which is also cylindrical. As with the variation of FIG. 18, this housing 171 opens into the internal central portion of the component 100. Such a design may advantageously be obtained at low cost by longitudinal localized milling of the internal circumference of the end zone 2. This housing 171 has an opening over an angular sector representing less than 180° of the circular section of the housing in order to hold the liner 70 in place radially. In particular, this opening has an angular sector 174 of the order of 10° relative to the internal circumference of the end zone 2. This embodiment has the advantage of screwing the liner onto the sheath that has already been disposed in the housing 171 and thus of facilitating assembly operations from outside the end zone 2.

In the embodiments of FIGS. 5 to 17 described below, the liner 70 comprises grooves 69, 169 provided from the external surface 75 and on a portion located axially on the side of the tail terminal surface 72. The grooves 69, 169 are substantially parallel to the principal axis of the liner 70. The grooves 69, 169 open into the tail terminal surface 72. The grooves 69, 169 are open on the external surface 75. The grooves 69, 169 are distributed in the circumference of the liner 70. The grooves 69, 169 comprise a base surface 78 which is substantially parallel to the principal axis of the liner 70. The grooves 69, 169 comprise long sides 76 which are mutually facing. The sides 76 circumferentially define the grooves 69, 169. The grooves 69, 169 comprise a base 77. The base 77 is a surface substantially perpendicular to the axis of revolution of the liner 70 and axially defines the grooves 69, 169 in the liner 70. In the installed condition of the liner 70 in the tubular body 1, the grooves 69, 169 are defined, on the radially outwards side, i.e. on the side of the external surface 75, by a portion of the bore of the first end zone 17, respectively of the second end zone 27.

In the example described here, the base surface 78 is flat. The sides 76 are flat and parallel to each other. The base 77 is flat. In a variation, the base surface 78 has a profile in the shape of a circular arc concentric with the external surface 75, i.e. it is substantially parallel to the external surface 75 and the bore 73. The sides 76 are each included in a plane passing through the axis of the liner 70. The base 77 is dome-shaped. The profile of the groove 69, 169, viewed parallel to the axis of the liner 70 from the tail terminal surface 72, has substantially the shape of a portion of a torus.

The portion of the bore of the first end zone 17, respectively the second end zone 27, left free by the liner 70 after placing it in the tubular body 1, defines a housing to accommodate a transmission device 81, not shown, at each of the axial ends of the tubular component 100. When the liner 70 is installed in the corresponding end zone 2, 3, the grooves 69, 169, which are open axially, can accommodate indexing tabs of the transmission device 81.

In the embodiment of FIGS. 18 and 19, the transmission device, not shown, is brought into contact with the head terminal surface 71 of the liner 70. The transmission device 81 is retained by inserting tabs of the transmission device into complementary dogs 173 provided in the thickness of the tubular body 1, and possibly in the thickness of the liner 70.

The transmission device 81 may provide direct, capacitive, inductive or electromagnetic coupling, depending on whether it is low or high frequency.

The groove 169 of the liner 70 also comprises a channel 76*a* provided in each of the sides 76. The channels 76*a* extend substantially perpendicular to the axis of revolution of the liner 70. The channels 76*a* may be used by matching the shape of a retention dog located on a tab of a transmission device 81, said tab being inserted in the groove 169. In a variation, similar channels 76*a* may be provided in the other grooves 169 or said channels 76*a* may be absent from the liner 70. In a variation, the sides 76 and the base surface 78 of the same groove 69, 169 may be substantially continuous in order to form, for example, a substantially semi-cylindrical surface, see FIGS. 12 and 13.

The base 77 of the groove 169 is pierced with a through hole 79 substantially parallel to the principal axis of the liner 70 and opening in the internal tapered surface 74 close to the head terminal surface 71. The hole 79 comprises a portion 79*a* with a bore which is substantially cylindrical located axially on the side of the head terminal surface 71 and a threaded portion located axially between the bore portion 79*a* and the base 77. In other words, the liner 70 comprises a longitudinal cavity opening on either side of the liner 70 disposed in the thickness of the wall of the liner 70. This cavity forms a portion of the communications line of the tubular component 100 included in the end zones 2 and 3. The threading of the threaded portion is given reference numeral 80*a* in the first end zone 2, respectively 80*b* in the second end zone 3. The threading 80*a*, respectively 80*b*, is a female threading. The threading 80*a*, respectively 80*b* may be an internal screw thread. The female threadings 80*a*, respectively 80*b*, are arranged in a wall of the liner 70. The female threadings 80*a*, respectively 80*b* correspond respectively to the male threadings 43 and 53 of the sheath 4 with which they are intended to come into engagement. The liner 70 supports a threading 80*a*, respectively 80*b*.

Figure 8:
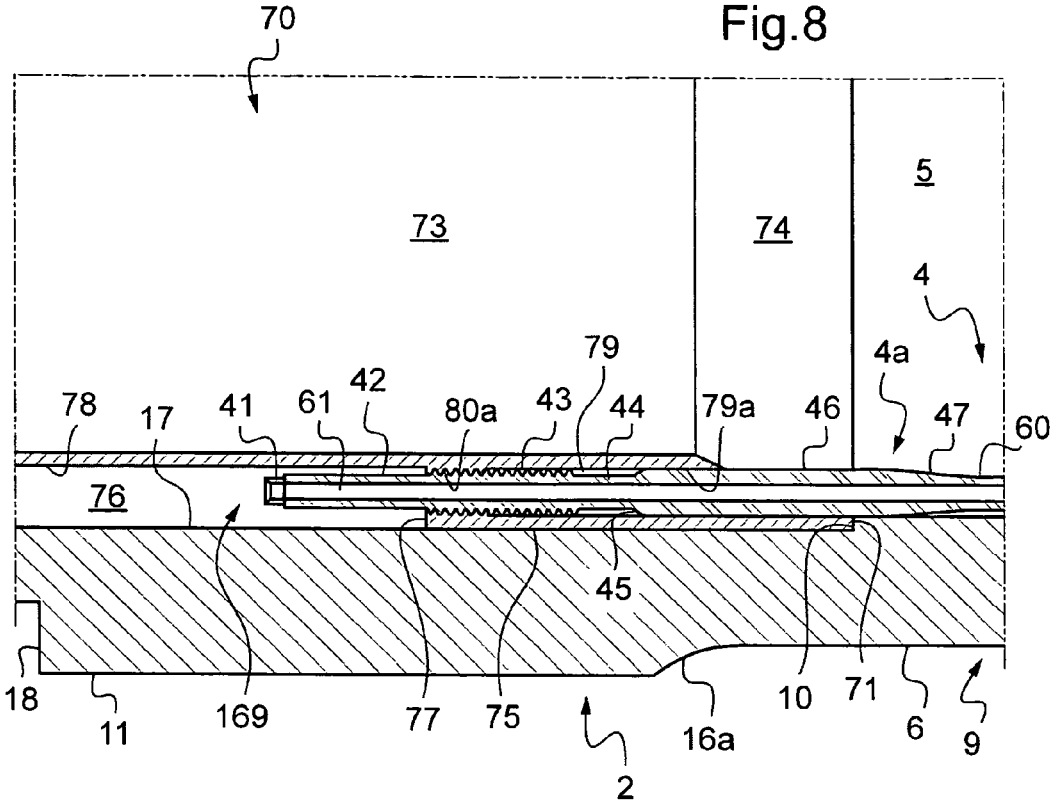
FIG. 8 is a diagrammatic view in section and in detail of a component.

FIG. 8 represents the first portion 4*a* of the sheath 4 in the installed condition in the liner 70 of the first end portion 2. The male threading 43 of the first portion 4*a* of the sheath 4 is screwed into the threading 80*a* of the liner 70 of the first end zone 2. The small diameter external cylindrical surface 42 and the actuating surface 41 of the first portion 4*a* of the sheath 4 are disposed in the groove 169. The external small diameter cylindrical surface 44 and the link 45 of the first portion 4*a* are disposed in the bore portion 79*a* of the hole 79. A portion of the large diameter cylindrical surface 46 of the first portion 4*a* is disposed in the bore portion 79*a* of the hole 79. The diameter of the large diameter cylindrical surface 46 and the diameter of the bore 79*a* of the hole 79 are arranged to match so that the annular space between these two elements is minimized apart from manufacturing tolerances. The remainder of the large diameter cylindrical surface 46, the tapered surface 47 and the intermediate portion 60 of the sheath 4 are disposed outside the liner 70, axially beyond the head terminal surface 71. The intermediate portion 60 extends axially in the intermediate portion 9 of the tubular body 1. Preferably, the intermediate portion 60 is flush against the intermediate bore 5 of the intermediate portion 9. When installed in the tubular component 100, the liner 70 forms a retaining means for the first end portion 4*a* of the sheath 4 with respect to the tubular body 1.

Figure 9:
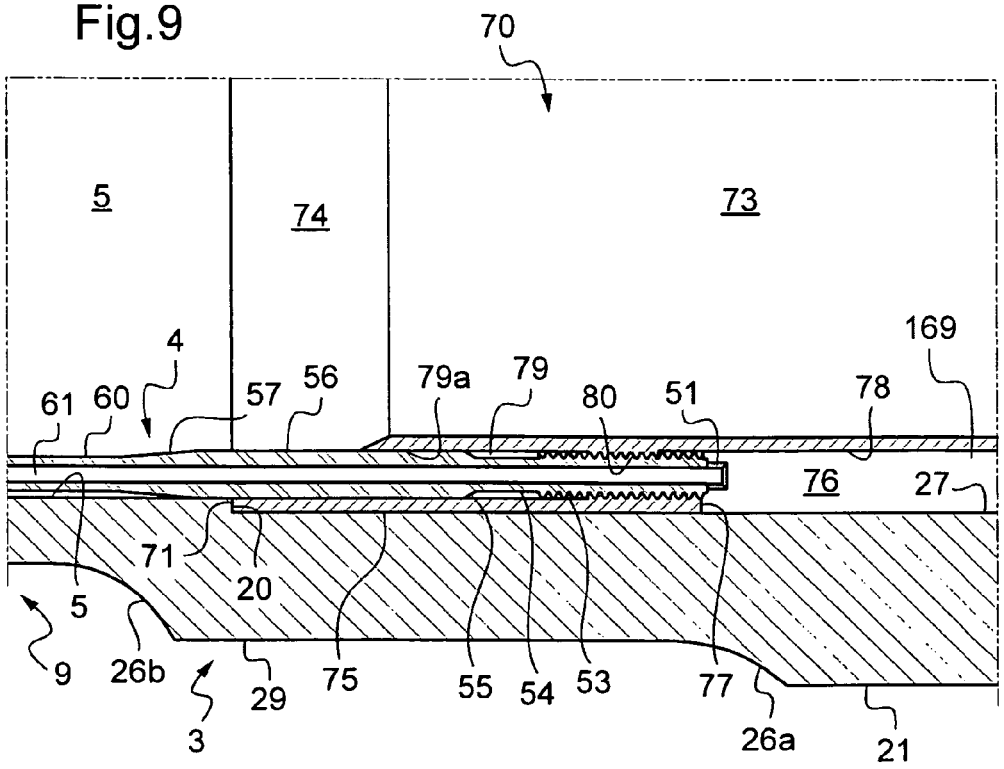
FIG. 9 is a diagrammatic view in section and in detail of the component.

At the other axial end of the tubular component 100 and substantially symmetrically in FIG. 9, the second portion 4*b* of the sheath 4 is in the installed condition in the liner 70 of the second end zone 3. The male threading 53 of the second portion 4*b* of the sheath 4 is screwed into the threading 80*b* of the liner 70 of the second end zone 3. The actuating surface 51 of the second portion 4*b* of the sheath 4 is disposed in the groove 169. The small diameter external cylindrical surface 54 and the link 55 of the second portion 4*b* are disposed in the bore portion 79*a* of the hole 79. A portion of the large diameter cylindrical surface 56 of the second portion 4*b* is disposed in the bore portion 79*a* of the hole 79. The diameter of the large diameter cylindrical surface 56 and the diameter of the bore 79*a* of the hole 79 are arranged to match in shape so that the annular space between these two elements is minimized apart from manufacturing tolerances. The remainder of the large diameter cylindrical surface 56, the tapered surface 57 and the intermediate portion 60 of the sheath 4 are disposed outside the liner 70, axially beyond the head terminal surface 71. When installed in the tubular component 100, the liner 70 forms a retention means for the second end portion 4*b* of the sheath 4 with respect to the tubular body 1.

The radial section of the liner 70, perpendicular to its longitudinal axis, in this case has the shape of a closed ring. In a variation shown in FIG. 17, the radial section of the liner 70 may take the form of an open ring segment such that once the liner 70 is disposed in the bore of the first end zone 17, respectively the second end zone 27, an angular section of said bore of the first end zone 17, respectively the second end zone 27, remains free. In other words, the liner 70 is then a part with a generally tubular shape with the exception of an opening over an angular portion and over at least a portion of its length, or even over its entire length as is the case in FIG. 17. In one configuration, the radial section of the liner 70 covers at least 180° of the angular portion so that it retains itself in the bore of the first end zone 17 or respectively the second end zone 27.

Thus, the component 100 has a cross section of passage for mud that is slightly smaller than that of the bare tubular body 1.

Figure 17:
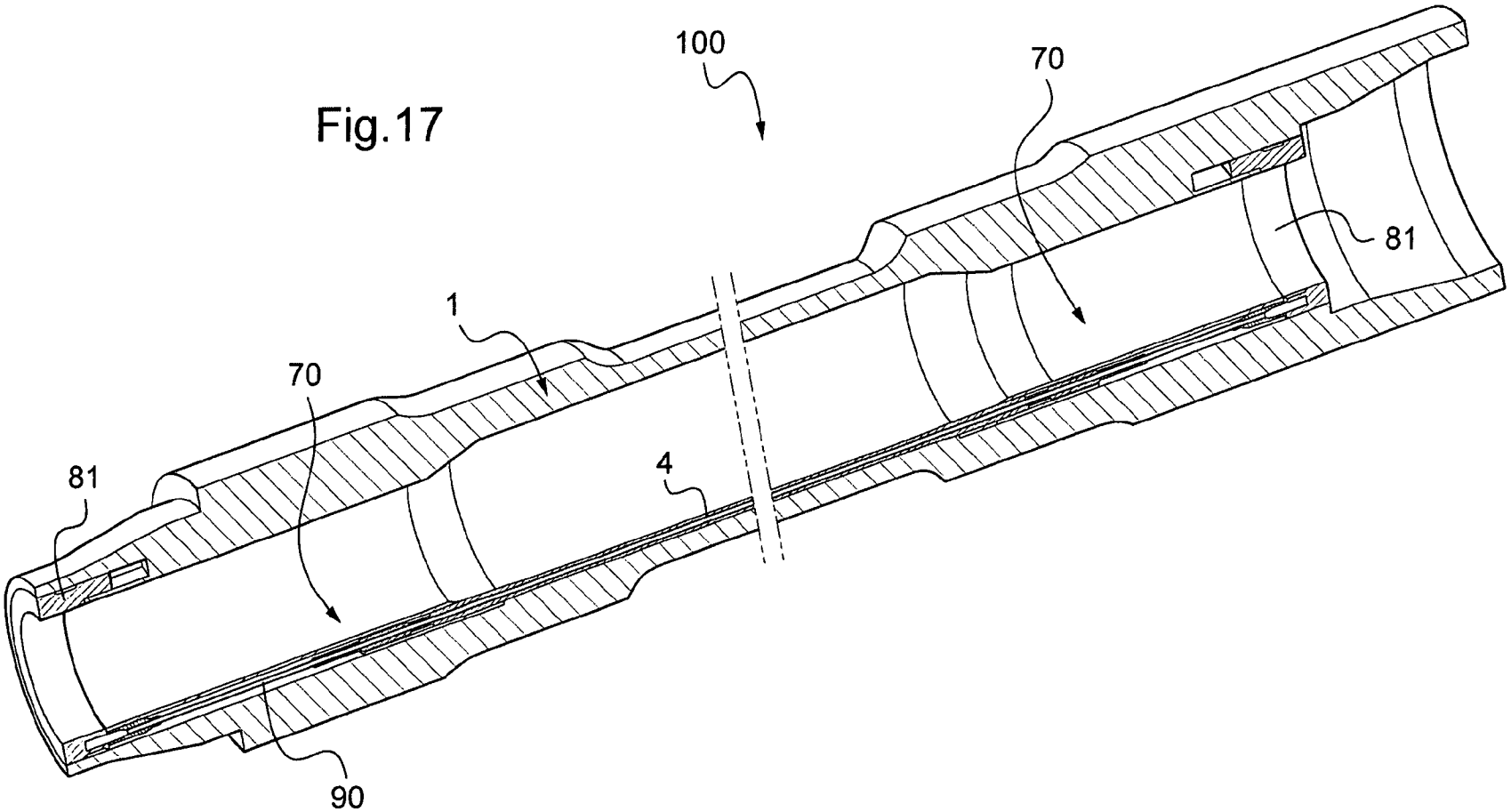
FIG. 17 is a diagrammatic view in longitudinal section and in perspective of a cabled component.

The cross section of passage is thus off-centre in the tubular body 1. In another variation, the radial section of the liner 70 covers less than 180° and is held in position by interaction with the angular abutment surfaces provided in the bore of the first end zone 17, respectively the second end zone 27, of the tubular body 1, as can be seen in FIG. 17. The radial section of the liner 70 has a circumferential dimension which is strictly greater than the external diameter of the end portion 4*a*, 4*b* of the sheath intended to be fixed in the liner 70. The liner 70 may thus be semi-annular. In this configuration, the bore of the first end zone 17 and/or the second end zone 27 is overlaid by the external surface 75 of each liner 70 over an angular space of the tubular body 1 which is strictly less than 360°. The minimum angular space lined by the liner 70 is limited by the external diameter of the end portion 4*a*, 4*b* of the sheath 4 since the liner 70 supports the threading 80*a*, 80*b* accommodating said end portion 4*a*, 4*b*.

Figures 10A, 10B:
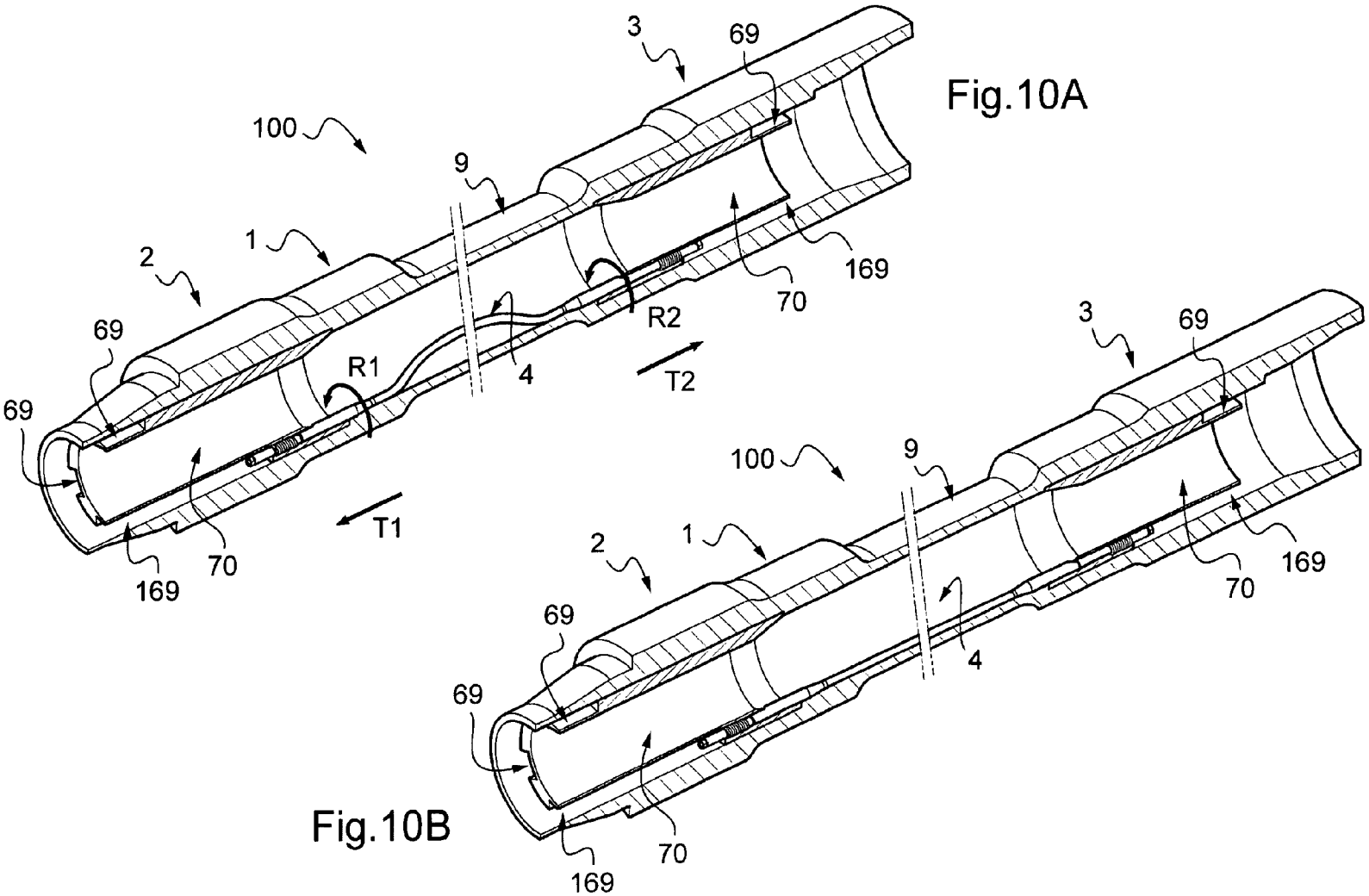
FIGS. 10A and 10B are diagrammatic views in longitudinal section and in perspective of the installation steps, with the sheath being shown.
Figure 12:
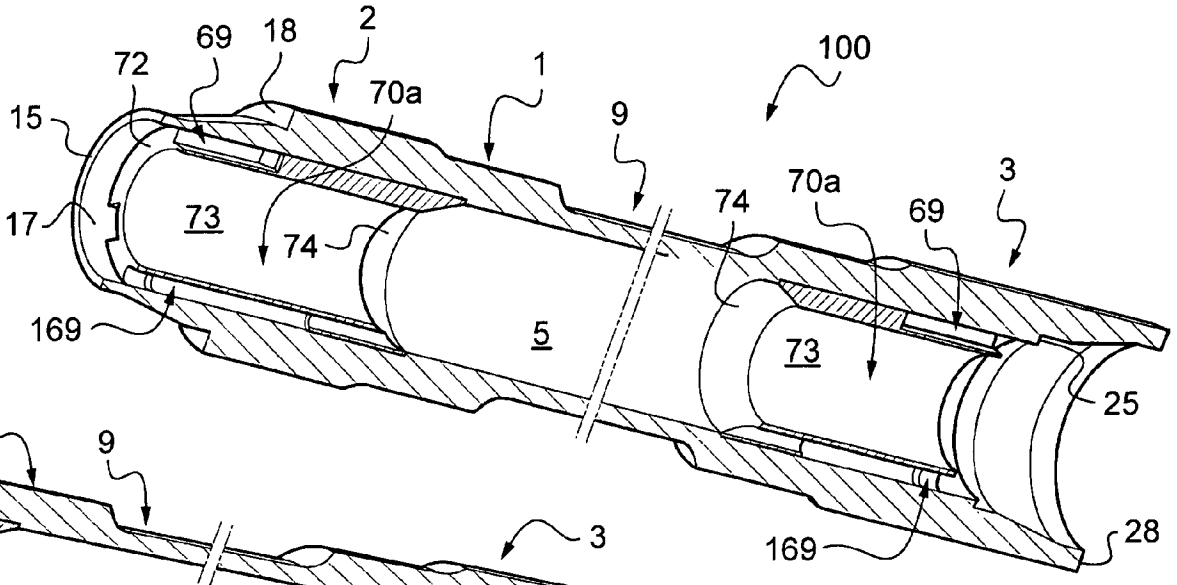
FIG. 12 is a diagrammatic view in longitudinal section and in perspective of a tubular component, with the sheath not being shown.
Figure 13:
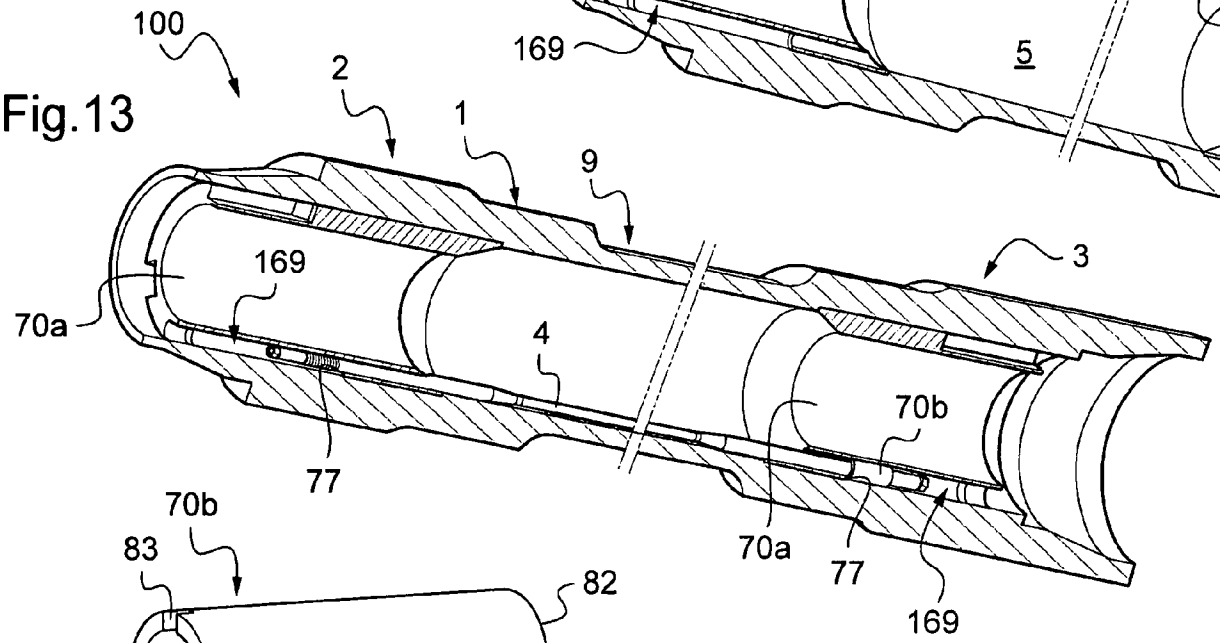
FIG. 13 is a diagrammatic view in longitudinal section and in perspective of a tubular component, an element of the liner not being shown, with the sheath being shown.
Figure 15:
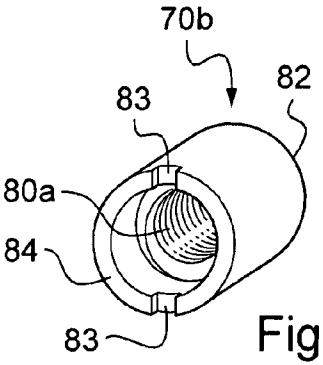
FIG. 15 is a view of the element of FIG. 14 from a different angle.

The term "screwing up" means the operation consisting of rotation and translation of a threaded portion of the sheath with respect to the corresponding threading of the tubular body and for which translation of the portion of the sheath is in the direction orientated from the intermediate portion towards a corresponding end (in the direction of the arrows T1 and T2 in FIG. 10A). In contrast, the term "unscrewing" means the operation during which translation is carried out from the end towards the intermediate portion (in the direction opposite to that of the arrows T1 and T2 in FIG. 10A). Screwing up (or unscrewing) is defined by a translation and a rotation. A screwing up direction is defined by a combination of the direction of translation (T1 to T5) with the direction of rotation (R1 to R5). Screwing up also encompasses the technique of applying an angle of screwing after having tensed the sheath 4 to remove the risk of friction between the complementary threads.

A direction of screwing up is imposed by the direction of the threaded threadings, i.e. left or right handed. Two screwing up operations with identical directions of translation and identical directions of rotation have identical directions of screwing up. Similarly, two screwing up operations with directions of translations which are opposite and directions of rotations which are opposite have identical directions of screwing up. In contrast, two screwing up operations with identical directions of translation and directions of rotation which are opposite have opposite directions of screwing up and two screwing up operations with opposite directions of translation and directions of rotation which are identical have opposite directions of screwing up.

FIGS. 10A and 10B represent the steps in installation of the sheath 4 in the tubular component 100 in a first embodiment. In this embodiment, the threadings 80*a* and 80*b* of each of the end zones 2 and 3 of the tubular body 1 are substantially symmetrical with respect to a transverse plane. In the example described here, the male threading 43 of the first end portion 4*a* of the sheath 4 and the threading 80*a* corresponding to the first end zone 2 of the component 100 (on the left in the figures) have a right hand thread. Screwing up is carried out by applying a torque in the clockwise direction from a point of view orientated from the intermediate portion 9 towards the first end zone 2. This is the most common direction of screwing up in the field of screws. In contrast, the male threading 53 of the second end portion 4*b* of the sheath 4 and the threading 80*b* of the second end zone 3 of the component 100 (on the left in the figures) have a left hand thread. Screwing up is carried out by applying a torque in the anticlockwise direction from a viewpoint orientated from the intermediate portion 9 to the second end zone 3. The threadings 43 and 80*a* on the one hand and 53 and 80*b* on the other hand, have screwing up translational directions T1 and T2 which are opposed, orientated towards each of the ends, and screwing up directions of rotation R1 and R2 which are identical. The threadings 43 and 80*a* on the one hand and 53 and 80*b* on the other hand thus have opposed directions of screwing up (T1; R1), respectively (T2; R2).

In the example described here, screwing up the sheath 4 is carried out by applying to the sheath 4 a rotation in the clockwise or anti-trigonometric direction viewed from the end of the second end zone 3. In contrast, viewed from the end of the first end zone 2, screwing up of the sheath 4 is carried out by applying a rotation to the sheath 4 in the anticlockwise or trigonometric direction.

The first end portion 4*a* of the sheath 4 is inserted into the first end zone 2. The second end portion 4*b* of the sheath 4 is inserted into the second end zone 3. The dimensions and the composition provide the sheath 4 with sufficient flexibility to be able to bend the sheath 4 in order to insert portions 4*a* and 4*b* into the linings 70 and in the opposite directions T1 and T2. This means that the sheath 4 is installed in the component 100 while the linings 70 are already in their functional position, i.e. abutting against the shoulders 10, 20 of the tubular body 1. When the male threading 43, respectively 53, is aligned with the threading 80*a*, respectively 80*b*, screwing up may commence. The threading 43 of the first portion 4*a* is screwed up (T1; R1) with the threading 80*a* of the liner 70 of the first end zone 2. Screwing up (T1; R1) may be brought about by applying a torque to the first end portion 4*a* of the sheath 4. The threading 53 of the second end portion 4*b* is screwed up (T2; R2) with the threading 80*b* of the liner 70 of the second end zone 3. Screwing up (T2; R2) may be brought about by applying a torque to the second end portion 4*b* of the sheath 4. In this embodiment, screwing up (T1; R1) and (T2; R2) the threadings in opposite directions brings about simultaneous and opposed translations T1 and T2 of each of the portions 4*a* and 4*b* of the sheath 4. During screwing up, the sheath 4 undergoes rotation R1; R2 about its own axis of revolution, even though the sheath 4 is in a curvilinear disposition. During screwing up, each of the portions 4*a* and 4*b* undergo a translation T1, respectively T2, in opposite directions. The first portion 4*a* and the second portion 4*b* of the sheath 4 are thus mutually separated and the sheath 4 is placed under tension in the direction substantially parallel to the axis of the tubular body 1. Initially, the sheath 4 takes up a substantially rectilinear disposition. Then, screwing up of the sheath 4 means that a tensile load can be applied. The tensile load applied to the sheath 4 may be carefully selected by adjusting the number of turns during screwing up of the sheath 4. FIG. 10B shows the sheath 4 in the tubular component 100 at the end of screwing up. By reversing each of the directions of the threading, the installation principle remains the same, the directions of screwing up remain opposed, and the direction of the torque to be applied is reversed.

This screwing up technique described above means that the formation of torsional stress along the intermediate portion 60 can be avoided if rotations R1; R2 are concomitant.

FIGS. 11A to 11F show the steps in installing a sheath 4 in a tubular body 1 in accordance with a second embodiment. In FIGS. 11A to 11F, the inclination of the threads forming the threadings 43 and 53 have deliberately been exaggerated to aid understanding of the directions of the threadings (left handed or right handed). In this embodiment, the threadings 80*a* and 80*b* of each of the end zones 2 and 3 of the tubular body 1 are substantially asymmetrical with respect to a plane dividing the intermediate portion 9 perpendicular to the axis of revolution of the tubular body 1. In the example described here, the male threading 43 of the first end portion 4*a* of the sheath 4 and the threading 80*a* of the first end zone 2 of the component 100 have right handed threads. The male threading 53 of the second end portion 4*b* of the sheath 4 and the threading 80*b* of the second end zone 3 of the component 100 also have right handed threads. The threadings 43 and 80*a* on the one hand and 53 and 80*b* on the other hand have translation directions of screwing up T3 and T4 which are opposed towards each of the ends and opposed directions of screwing up of rotation R3 and R4. The threadings 43 and 80*a* on the one hand and 53 and 80*b* on the other hand thus have identical directions of screwing up (T3; R3), respectively (T4; R4). In this configuration, application of a torque in the selected direction to the sheath 4 causes screwing up of one of its end portions 4*a;* 4*b* and unscrewing of the other end portion 4*b;* 4*a*. These identical directions of screwing up mean that screwing up of each of the portions 4*a* and 4*b* of the sheath 4 is decoupled. In contrast to the embodiment of FIGS. 10A and 10B, simultaneous application of a torque in the same direction to each of the end portions 4*a* and 4*b* of the sheath 4 does not simultaneously cause the two screwing up operations.

During installation in this embodiment, in a first step shown in FIG. 11A, the liner 70 of the first end zone 2 is at a distance from the shoulder 10. The liner 70 may also not already be inserted in the first end zone 2. The liner 70 of the second end zone 3 is in its final position, i.e. abutting against the shoulder 20 of the second end zone 3. The first end portion 4*a* of the sheath 4 is inserted in the first end zone 2. The second end portion 4*b* of the sheath 4 is inserted in the second end zone 3. The sheath 4 is disposed at rest, i.e. unstressed, in the tubular body 1.

The second portion 4*b* of the sheath 4 is inserted in the liner 70 of the second end zone 3 via the opening located axially to the side of the head terminal surface 71, see FIG. 11B. The male threading 53 is screwed into the threading 80*b* of the second end zone 3. Screwing up (T2; R3) may be brought about by application of a torque to the second end portion 4*b* of the sheath 4. In the example described here, screwing up consists of a translation T3 orientated from the intermediate portion 9 towards the second end zone 3 of the tubular body 1, combined with a rotation R3 in the clockwise direction viewed from the intermediate portion 9. Screwing up is carried out such that a significant portion of the male threading 43 leaves the threading 80*b* on the axial side opposite to the intermediate portion 9. In other words, a portion of the small diameter cylindrical surface 54 of the second portion 4*b* of the sheath 4 is located axially in the threading 80*b*. The link 55 may come into abutment against the axial base 77. The sheath 4 is then axially offset (towards the right in the figures) from its final position.

Next, the liner 70 of the first end zone 2, shown in in FIG. 11C, may be brought into its final position in the first end zone 2 of the tubular body 1. The first portion 4*a* of the sheath 4 is fed into the through hole of the liner 70 in a direction orientated from the head terminal surface 71 towards the tail terminal surface 72, in the direction T4. The small diameter external cylindrical surface 42 of the first end portion 4*a* is then in the threading 80*a*. The male threading 43 of the first portion 4*a* may in turn be screwed into the threading 80*a* of the first end zone 2. The male threading 43 is screwed into the threading 80*a* of the first end zone 2. Screwing up (T4; R4) may be brought about by applying a torque to the first end portion 4*a* of the sheath 4. Screwing up is carried out by applying a rotation R4 to the sheath 4 in the clockwise direction viewed from the intermediate portion 9. Screwing up (T4; R4) may be carried out substantially simultaneously with insertion of the liner 70 into the first end zone 2. Screwing up (T4;R4) may be carried out after insertion of the liner 70 into the first end zone 2 by flexing the sheath 4, as in the embodiment of FIGS. 10A and 10B.

In the two embodiments described so far (FIGS. 10A to 10F), the sheath 4 is formed as a single part. This provides the sheath 4 with low bulk, good mechanical strength, good homogeneity over its length and simple, cheap manufacture. Simultaneously with screwing (T4; R4) the first portion 4*a* of the sheath 4 into the first end zone 2, the second portion 4*b* of the sheath 4 undergoes unscrewing (T5; R5) in the second end zone 3, as can be seen in FIG. 11D. In other words, the screwing up operation shown in FIG. 11C and the unscrewing operation represented in FIG. 11D may be carried out substantially simultaneously by application of a torque in the same direction. This torque causes rotation R4;R5 of the sheath 4 about its own axis of revolution. The sheath 4 then undergoes rotations R4 and R5 in identical senses at each of its portions 4*a* and 4*b* and translations T4 and T5 in identical directions at each of is portions 4*a* and 4*b*. This screwing up-unscrewing operation is carried out until the desired final position of the sheath 4 is obtained in the tubular body 1. A final position of the portion 4*a* of the sheath 4 in the first end zone 2 is represented in FIG. 11E, while a final disposition of the second portion 4*b* of the sheath 4 in the second end zone 3 is represented in FIG. 11F. By reversing each of the threading directions or by reversing the directions of each of the applied torques, the installation principle remains the same but the side of the first end zone 2 is then subjected to over torquing and unscrewing while the side of the second end zone 3 undergoes the screwing up step of FIG. 11C.

Further, in the two embodiments described so far (FIGS. 10A to 11F), each of the pairs of threadings (43; 80*a* and 53; 80*b*) have identical pitches. This means that substantially homogeneous screwing up and unscrewing torques can be applied to each of the end portions 4*a* and 4*b* of the sheath 4 for the same quantity of axial displacement of each of these end portions 4*a* and 4*b* in the tubular body 1. This facilitates adjustment of the pre-stress loading applied for retention.

In a variation, the male threading 43 of the first end portion 4*a* and the threading 80*a* of the first end zone 2 on the one hand and the male threading 53 of the second portion 4*b* and the threading 80*b* of the second end zone 3 on the other hand have different values for the pitches. This means that, for a given number of rotational turns at each of the end portions 4*a* and 4*b* of the sheath 4 about its own axis of revolution, translations of each of its portions 4*a* and 4*b* can be obtained which have different absolute values. This variation is of particular advantage when applied to the embodiment of FIGS. 11A to 11F. During the screwing up-unscrewing operations of FIGS. 11C and 11D, a pitch of the threadings 43 and 80*a* with a value higher than that of the pitch of the threadings 53 and 80*b* applies, for the same rotation R4, R5, a translation T4 with an absolute value which is higher than that of the translation T5. The first portion 4*a* and the second portion 4*b* of the sheath 4 are thus both displaced in the tubular body 1 (towards the left in the figures) and simultaneously mutually separated. The sheath 4 is tensed in an axis substantially parallel to the axis of revolution of the tubular body 1. In a variation of FIGS. 10A and 10B, different pitches mean that the final separation between each of the end portions 4*a* and 4*b* of the sheath 4 can be finely adjusted.

An alternative to the single-piece feature of the sheath 4 is compatible with each of the two embodiments described above and with identical or different pitches. In this alternative, the first portion 4*a* and the second portion 4*b* of the sheath 4 are mutually free in rotation about an axis of the sheath 4. This means that the steps of screwing up and unscrewing each of the end portions 4*a* and 4*b* in the tubular body 1 can be separated, for example carried out at different times. In other words, rotation of one of the portions 4*a*, 4*b* of the sheath 4 independently of rotation of the other portion 4*b*, 4*a* of the sheath 4 creates no or only slight torsion in the sheath 4. Minimizing the torsion applied to the sheath 4 facilitates holding it against the intermediate bore 5 of the intermediate portion 9, thereby reducing the risk of it twisting.

An example of this alternative is shown in FIG. 16. The first portion 4*a* and the second portion 4*b* of the sheath 4 are connected via a rotary seal. The first portion 4*a* of the sheath 4 comprises an intermediate female portion 60*a*. The second portion 4*b* of the sheath 4 comprises an intermediate male portion 60*b*. The female 60*a* and male 60*b* intermediate portions are distinct. The internal diameter of the female portion 60*a* is greater than the external diameter of the male portion 60*b* so that the male portion 60*b* is inserted at least in part into the female portion 60*a*. At its end orientated to the side of the second portion 4*b*, the female portion 60*a* comprises an internal rib forming a reduction in the internal diameter. At a small distance from its end orientated to the side of the first portion 4*a*, the male portion 60*b* comprises an external groove forming a reduction in the external diameter. The distance between the end of the female portion 60*b* and the external groove is, for example in the range 1 to 5 millimeters. A rotary seal 60*c* or O-ring is disposed in the groove of the male portion 60*b* so that the rotary seal 60*c* projects from the groove. The male portion 60*b* is inserted in the female portion 60*a* and so the projecting portion of the rotary seal 60*c* abuts against an internal surface of the internal rib of the female portion 60*a*. In the installed condition, the male portion 60*b* of the second portion 4*b* is free to rotate in the female portion 60*a* of the first end portion 4*a*. The rotary seal 60*c* axially links the first end portion 4*a* with the second end portion 4*b* of the sheath 4. Displacement in translation tending to separate each of the end portions 4*a*, 4*b* of the sheath is prevented. Displacement in translation tending to cause each of the end portions 4*a*, 4*b* to interpenetrate is possible, and this in particular means that the process of installing the sheath 4 in the tubular body 1 in accordance with the embodiment of FIGS. 10A and 10B is possible without necessitating or reducing the amount of flexion to be applied to the sheath 4. This alternative means that, in a more general manner, screwing up and/or unscrewing the male threading 43 of the first end portion 4*a* with the threading 80*a* of the first end zone 2 on the one hand and the male threading 53 of the second portion 4*b* with the threading 80*b* of the second end zone 3 on the other hand are carried out independently. The rotational freedom provided by this rotary seal means that a torque can be applied to one of the end portions 4*a*, 4*b*, thereby reducing the effect of the torque on the other end portion 4*b*, 4*a*.

In the examples described so far, the threaded portions 80*a* and 80*b* of the holes 79 of the linings 70 are formed as one piece with the remainder of the liner 70. In other words, the liner 70 is constituted by a single unitary part. The threadings 80*a* and 80*b* are produced by machining the single-element liner 70. This configuration means that a reduced number of separate parts is required to form the component 100.

An alternative to the single-element linings 70 of the preceding examples is shown in FIGS. 12 to 15. This alternative is compatible with each of the embodiments, with identical or different pitches and with a unitary sheath 4 or where the end portions 4*a* and 4*b* are free to rotate. Identical numerical references to the preceding examples denote similar elements. In this alternative, the liner 70 comprises a tail element 70*a* and a head element 70*b*. The tail element 70*a* is equivalent to the liner 70 of the preceding embodiments with the threadings 80*a*, 80*b* in the hole 79 cut off. The hole 79 comprises a bore portion 79*a* which is substantially cylindrical over its entire axial length. The hole 79 opens into the tapered surface 74 on the one hand and into the base 77 on the other hand.

Figure 14:
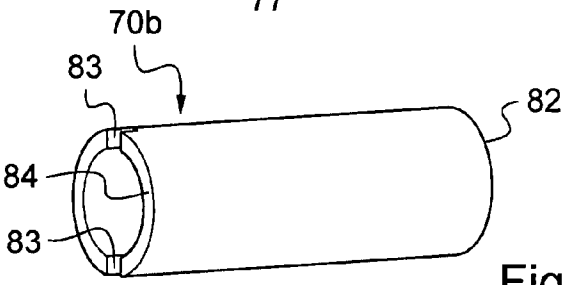
FIG. 14 is a diagrammatic view in perspective of a particular embodiment of an element of a liner for a component of the invention as shown in FIG. 13.

The head element 70*b*, shown alone in FIG. 14, has a substantially tubular shape and is formed using a suitable material, for example steel. The external dimensions of the head element 70*b* match the shape of the groove 169 of the tail element 70*a*. The internal surface of the head element 70*b* supports the threading 80*a* of the first end zone 2, respectively 80*b* of the second end zone 3. The head element 70*b* comprises an annular head terminal surface 82. In the installed condition, the head terminal surface 82 is orientated towards the intermediate portion 9 and bears against the axial base 77 of the tail element 70*a*. Opposite this head terminal surface 82, the head element 70*b* comprises a radial tail terminal surface 84. In the example described here, the radial surface 84 is provided with screwing up (and unscrewing) recesses 83. Screwing up recesses 83 are arranged to cooperate with a screwing up tool. Screwing up recesses 83 in the example described here consist of two grooves formed in the radial surface 84 which are substantially diametrically opposed. Insertion of a screwing up tool into each of these screwing up recesses 83 means that a torque can be applied to the head element 70*b*. It is then no longer necessary to provide clearance for a tool in an annular space around the head element 70*b*. In this manner, the radial bulk around the sheath 4 in the tubular body 1 is limited and the thickness required for the wall of the tail element 70*a* is limited.

Screwing up/unscrewing operations described concerning FIGS. 10A to 11D may be carried out by blocking rotation of the sheath 4 with respect to the tubular body 1. The torque applied to the sheath for screwing up or unscrewing may be applied from the first end zone 2 of the tubular body 1. The tail element 70*a* constitutes a shim. The tail element 70*a*, fixed with respect to the tubular body 1, is a mechanical intermediate, a buffer between the head element 70*b* and the tubular body 1. During and after screwing up a portion of the sheath 4*a*, 4*b* into the head element 70*b*, the head element 70*b* bears against the tail element 70*a* as a reaction to the axial tensile load on the sheath 4. The head terminal surface 82 bears against a perimeter of the hole 79 included in the surface forming the base 77. The liner 70 comprises the tail element 70*a* and the head element 70*b*. Each of the tail 70*a* and head 70*b* elements supports the female threading 80*a*, 80*b*. The head element 70*b* acts as a support for the female threading 80*a*, 80*b*. The threading 80*a*, 80*b* is machined in the head element 70*b* while the tail element 70*a* mechanically supports the threading 80*a*, 80*b* via the head element 70*b*. This configuration leaves the choice of installation/removal between applying a torque to the sheath 4, to the head element 70*b* of the liner 70 or to a combination of the two. In the event of changing a part during the lifetime of the component 100, it is possible to change a single element of the liner 70. This configuration means that the space located in the longitudinal extension of the sheath 4 can be used to insert screwing up tool and to apply screwing up/unscrewing torque to the head element 70*b* rather than (or as a complement to) applying it to the sheath 4. In other words, the liner comprises a tail element and a head element. The tail element lines at least a portion of the interior of the tubular body in the first end zone, respectively the second end zone. The head element supports the threading of the liner. Said threading of the liner and the threading of an end portion of the sheath are screwed together.

In summary the tubular component 100 may have:

an identical (FIGS. 11A to 11F) or opposed (FIGS. 10A and 10B) direction of screwing up the sheath; and/or identical or different threading pitches; and/or a unitary sheath or a sheath which is free to rotate between each of the end portions; and/or a single-element liner or at least two elements.

The possibilities for the embodiments and alternatives produce a combination matrix comprising $2^4$, i.e. 16 possible embodiments. Each of these combinations has particular advantages. However, the combination of the embodiment with identical directions of screwing up, with identical pitch values and with the single-element feature for the sheath renders it difficult to apply a tensile load to the sheath when installing it in the tubular body 1. In fact, the rotation applied to the sheath 4 produces translations with directions and values which are substantially identical at each of the end zones 2, 3 and total axial displacement of the sheath 4 with respect to the tubular body 1 renders it difficult to apply a different translation between each of the end portions 4*a*, 4*b* of the sheath 4. In other words, in order to facilitate axial tensioning of the sheath 4, the tubular component 100 has an opposite direction of screwing up of the sheath or has a different pitch for the threading or has a sheath where each of the end portions is free to rotate, or a combination of these three characteristics.

Another embodiment consists of a tubular component 100 wherein only one of the two end zones 2, respectively 3 is as described above. The direction of screwing up, the threading pitch and the dependency of rotation of each of the end portions of the sheath are selected. The other end zone 3, respectively 2 comprises another means for fixing the portion 4*a*, 4*b* of the sheath 4, leaving the latter free to rotate about its own axis or not. Tensioning of the sheath at the time of installation is then carried out by screwing up or unscrewing the sheath portion located at the side of the end zone provided with a liner and threadings while the other end portion of the sheath is locked in translation.

When the sheath 4 is installed in the tubular component 100, a cable 90 may be inserted into the sheath 4 from one end to the other of the tubular component 100. The cable 90 may be connected at each of its ends to a transmission device 81. Such a tubular component 100, ready to be assembled with other similar components, is shown in FIG. 17.

It can be seen that the tubular body 1, the liner(s) 70 and the sheath 4, to form the component 100, may be manufactured, sold and/or installed together or separately and thus form a kit. The device comprises parts which are inexpensive to manufacture. There are few parts and successive installation and removal operations are thus facilitated. The tubular component provided with its liner and its sheath screwed into the liner is easy to maintain. In the event of failure of the communications line, this may easily, rapidly and cheaply be replaced without requiring changing the remainder of the tubular component. The mechanical strength under difficult drilling conditions is improved and the longevity of the components is ensured. The reliability of communication from one end to the other of the drill pipe string is thus improved. The device can be adapted to the majority of existing tubular components, in particular those with a small diameter and thin walls. The tubular body is not, or is only slightly altered by the adaptation to form a component of the invention.

Advantageously, seals may be added to preserve the threadings 43, 53, 80*a* and 80*b* from mud infiltration. These seals could be elastomeric O-rings placed in compression between the sheath and the liner once the sheath is placed under tension between the two linings 70 held respectively at the end zones 2 and 3. These seals may also prevent involuntary unscrewing of the sheath 4 relative to the liner 70 due to the physical conditions to which such components are subjected during drilling.

The invention is not limited to the methods, apparatus and kits described above, given solely by way of example, but it encompasses any variation that the skilled person could envisage in the context of the claims below.

The invention claimed is:

1. A component for a drill stem, comprising:

a tubular body with at least one first end zone including a shoulder and a second end zone;

a sheath for passage of a cable extending inside the tubular body between the first end zone and the second end zone;

at least one liner which lines at least a portion of an inside of the tubular body in the first end zone, the liner abutting against the shoulder, at least one first end portion of the sheath including a first threading, the liner supporting a second threading, the first and second threadings being screwed together, wherein the first end portion of the sheath is free to rotate about an axis of the sheath with respect to a second end portion opposite to the first end portion.

2. A component according to claim 1, wherein the liner comprises an external surface overlaying at least a portion of an internal surface of the tubular body in the first end zone.

3. A component according to claim 1, wherein the first end zone comprises an internal surface, the liner comprising an external surface in contact with the internal surface of the first end zone over an angular space sector of the tubular body strictly less than 360°.

4. A component according to claim 1, wherein the liner comprises a wall with a thickness strictly greater than the external diameter of the first end portion of the sheath, the second threading being provided in the wall.

5. A component according to claim 1, wherein the liner comprises end surfaces, the tubular body further comprising an intermediate portion between the first end zone and the second end zone, each of axial ends of the liner being disposed axially at a distance from a junction between the intermediate portion and the first end zone.

6. A component according to claim 1, wherein the first end portion of the sheath comprises an actuating portion between a free end of the first end portion and the first threading.

7. A component according to claim 1, wherein the sheath further comprises a rotary seal between the first end portion and the second end portion.

8. A component according to claim 1, wherein the second end zone includes a second shoulder, the component further comprising:

a supplemental liner which lines at least a portion of the inside of the tubular body in the second end zone, the supplemental liner abutting against the second shoulder, a second end portion of the sheath opposite to the first end portion including a third threading, the supplemental liner supporting a fourth threading, the third and fourth threadings being screwed together.

9. A component according to claim 8, wherein, of the first threading and the third threading, one is a left handed threading and the other is a right handed threading.

10. A component according to claim 8, wherein the first threading and the third threading have different pitch values.

11. A component according to claim 8, wherein the second end portion of the sheath comprises a second actuating portion between a free end of the second end portion and the third threading.

12. A method for installation a drill stem component in which the component includes a tubular body having at least a first end zone including a shoulder and a second end zone and a sheath for the passage of a cable, the method comprising:

a) inserting a first end portion of the sheath including a first threading into the first end zone;

b) screwing the first threading together with a second threading supported by a liner which lines at least a portion of the interior of the tubular body in the first end zone and abutting against the shoulder;

c) inserting a second end portion of the sheath into the second end zone including a shoulder, a second end portion of the sheath opposite to the first end portion being provided with a third threading; and d) screwing the third threading and a fourth threading together, the fourth threading being supported by a supplemental liner which lines at least a portion of the interior of the tubular body in the second end zone and abuts against the shoulder, wherein the screwing is carried out by applying a torque in a same direction to the first end portion and to the second end portion of the sheath.

13. A method according to claim 12, wherein the screwing is brought about by applying a torque to the first end portion of the sheath, or after tensioning the sheath.

14. A method according to claim 12, wherein screwing and/or unscrewing operations of the first and the second threadings and of the third and fourth threadings are carried out independently.

* * * * *